US009747836B2

(12) United States Patent
Nakahata et al.

(10) Patent No.: US 9,747,836 B2
(45) Date of Patent: Aug. 29, 2017

(54) SIGNAL PROCESSING METHOD, DISPLAY DEVICE, AND ELECTRONIC APPARATUS

(71) Applicant: Sony Corporation, Tokyo (JP)

(72) Inventors: Yuji Nakahata, Tokyo (JP); Makoto Nakagawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 120 days.

(21) Appl. No.: 14/662,386

(22) Filed: Mar. 19, 2015

(65) Prior Publication Data

US 2015/0279281 A1 Oct. 1, 2015

(30) Foreign Application Priority Data

Mar. 31, 2014 (JP) ..... 2014-073773

(51) Int. Cl.
*G09G 3/32* (2016.01)
*G09G 3/3233* (2016.01)

(52) U.S. Cl.
CPC ... *G09G 3/3233* (2013.01); *G09G 2300/0452* (2013.01); *G09G 2300/0852* (2013.01); *G09G 2300/0866* (2013.01); *G09G 2320/0233* (2013.01); *G09G 2320/0271* (2013.01); *G09G 2320/0285* (2013.01); *G09G 2340/16* (2013.01)

(58) Field of Classification Search
None
See application file for complete search history.

(56) References Cited

U.S. PATENT DOCUMENTS 6,473,077 B1 * 10/2002 Takenaka ..... G09G 3/3648 345/100
6,771,243 B2 * 8/2004 Hirohata ..... G09G 3/20 345/690
2004/0135777 A1 * 7/2004 Shiomi ..... G09G 3/3648 345/204
2004/0263462 A1 * 12/2004 Igarashi ..... G09G 3/3648 345/98
2006/0284896 A1 * 12/2006 Shen ..... G09G 3/2007 345/690
2007/0290964 A1 * 12/2007 Yang ..... G09G 3/3648 345/87

(Continued)

FOREIGN PATENT DOCUMENTS

JP 2011-154237 8/2011
JP 2012-155953 8/2012

*Primary Examiner* — Antonio Xavier
(74) *Attorney, Agent, or Firm* — Michael Best & Friedrich LLP

(57) ABSTRACT

A signal processing method includes inputting a first gradation signal and a second gradation signal, the first gradation signal representing a gradation of a predetermined pixel in a first frame, the second gradation signal representing a gradation of the predetermined pixel in a second frame that follows the first frame; determining whether or not the gradation of the predetermined pixel in the first frame is a low gradation based on the input first gradation signal; and adjusting one of a first signal voltage and a second signal voltage in a case where the determination result is positive, the first signal voltage defining a light-emitting brightness of a light-emitting pixel corresponding to the predetermined pixel in the first frame, the second signal voltage defining a light-emitting brightness of the light-emitting pixel in the second frame.

13 Claims, 15 Drawing Sheets

(56) References Cited

U.S. PATENT DOCUMENTS

2008/0074513 A1* 3/2008 Noguchi ..... H04N 5/361 348/243
2008/0297497 A1* 12/2008 Lu ..... G09G 3/3648 345/208
2009/0136146 A1* 5/2009 Kaino ..... H04N 19/51 382/236
2009/0184918 A1* 7/2009 Feng ..... G09G 3/3426 345/102
2009/0190050 A1* 7/2009 Ohmuro ..... G02F 1/1393 349/33
2009/0262124 A1* 10/2009 Yamamoto ..... G09G 3/3611 345/565
2009/0268110 A1* 10/2009 Kitayama ..... G09G 3/3614 349/37
2010/0026838 A1* 2/2010 Belenky ..... H04N 5/35536 348/229.1
2010/0275102 A1* 10/2010 Yagi ..... H04L 1/0045 714/775
2010/0309381 A1* 12/2010 Nakagawa ..... H04N 13/0438 348/705
2011/0181626 A1 7/2011 Toyomura et al.
2011/0273489 A1* 11/2011 Inoue ..... G09G 3/3611 345/690
2011/0307673 A1* 12/2011 Engin ..... H03M 13/271 711/157
2012/0086873 A1* 4/2012 Miyata ..... G09G 3/3614 348/790
2012/0187425 A1 7/2012 Omoto
2013/0135297 A1* 5/2013 Kobayashi ..... G06T 15/00 345/419
2013/0235006 A1* 9/2013 Shin ..... G09G 3/003 345/204
2015/0279280 A1* 10/2015 Nakahata ..... G09G 3/3225 345/690
2015/0279281 A1* 10/2015 Nakahata ..... G09G 3/3233 345/690
2015/0279290 A1* 10/2015 Nakahata ..... G09G 3/2092 345/549

* cited by examiner

FIG.9A

Duty: 90%

| input | output |
|---|---|
| 0 | 0 |
| 16 | 15 |
| 32 | 29 |
| 48 | 45 |
| 64 | 60 |
| 80 | 76 |
| 96 | 92 |
| 112 | 109 |
| 128 | 125 |
| 144 | 143 |
| 160 | 160 |
| 176 | 176 |
| 192 | 192 |
| 208 | 208 |
| 224 | 224 |
| 240 | 240 |
| 255 | 255 |

FIG.9B

Duty: 60%

| input | output |
|---|---|
| 0 | 0 |
| 16 | 16 |
| 32 | 31 |
| 48 | 47 |
| 64 | 63 |
| 80 | 79 |
| 96 | 95 |
| 112 | 111 |
| 128 | 127 |
| 144 | 144 |
| 160 | 160 |
| 176 | 176 |
| 192 | 192 |
| 208 | 208 |
| 224 | 224 |
| 240 | 240 |
| 255 | 255 |

FIG.9C

Duty: 30%

| input | output |
|---|---|
| 0 | 0 |
| 16 | 17 |
| 32 | 33 |
| 48 | 50 |
| 64 | 66 |
| 80 | 82 |
| 96 | 98 |
| 112 | 114 |
| 128 | 129 |
| 144 | 145 |
| 160 | 160 |
| 176 | 176 |
| 192 | 192 |
| 208 | 208 |
| 224 | 224 |
| 240 | 240 |
| 255 | 255 |

FIG.18A
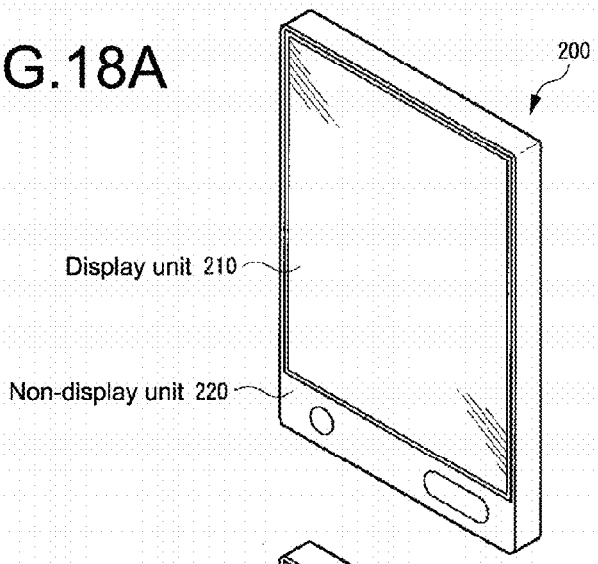
FIG.18B
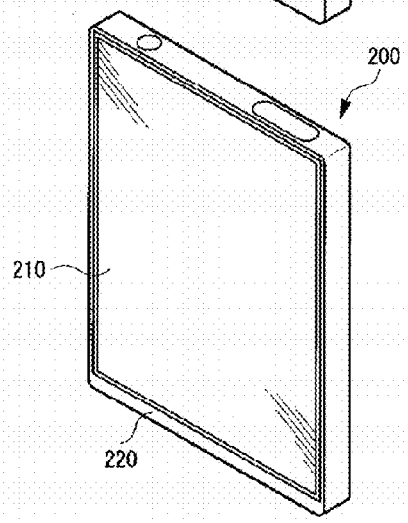
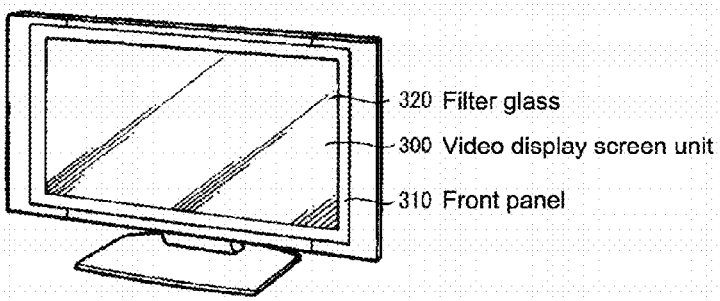
FIG.19

SIGNAL PROCESSING METHOD, DISPLAY DEVICE, AND ELECTRONIC APPARATUS

CROSS REFERENCE TO RELATED APPLICATIONS

This application claims the benefit of Japanese Priority Patent Application JP 2014-073773 filed Mar. 31, 2014, the entire contents of which are incorporated herein by reference.

BACKGROUND

The present disclosure relates to a signal processing method for displaying an image, a display device, and an electronic apparatus.

In the past, some display devices use, as a light-emitting unit of a pixel (light-emitting element), a so-called current drive type electro-optical element in which the light-emitting brightness varies depending on the value of an applied current. As the current drive type electro-optical element, an organic electroluminescence (EL) element that includes an EL organic material and uses the phenomenon of emitting light when an electric field is applied to an organic thin film has been known.

The organic EL display device that uses an organic EL element as a light-emitting unit of a pixel has the following features. Specifically, the power consumption of the organic EL element is low because the organic EL element can be driven with an applied voltage of not more than 10 V. In addition, the visibility of an image is high in the organic EL element as compared with a liquid crystal display device because the organic EL element is a self-light-emitting element. Furthermore, it is easy to reduce the weight and thickness of the organic EL element because the organic EL element does not need an illumination member such as a back light. Furthermore, no after-image is generated during movie display in the organic EL element because the response speed of the organic EL element is very high, e.g., several μ sec.

In the organic EL display device disclosed in Japanese Patent Application Laid-open No. 2012-155953, as shown in FIG. 10 or the like thereof, a metal wiring 90 is formed in the same layer in which an anode electrode 211 is formed. The metal wiring 90 is electrically connected to an organic layer (a charge injection layer 214 and connection layers 216 and 217), and is set to have a potential lower than that of the anode electrode 211 at the time of non-light emission. Accordingly, a leakage current flowing through the organic layer is prevented from flowing to an adjacent pixel. As a result, it is possible to prevent the adjacent pixel from emitting light due to the leakage current, and to achieve favorable color reproducibility (color purity) (see, for example, paragraphs 0098 to 0105 in the specification of Japanese Patent Application Laid-open No. 2012-155953).

On the other hand, in the organic EL display device disclosed in Japanese Patent Application Laid-open No. 2011-154237, as shown in FIG. 8 or the like thereof, a plurality of horizontal lines are taken as one unit, and a threshold compensation operation is performed at the same time in each pixel circuit within the same unit. After completion of the threshold correction operation, a video signal voltage is input sequentially for each pixel unit, and light emission is performed with the brightness corresponding to the input video signal voltage. At this time, at every unit, an input of a video signal voltage in the order from a first line to a final line and an input of a video signal voltage in the order from the final line to the first line are alternately performed. Accordingly, it is possible to improve the quality of a screen because a stripe on the boundary portion of the units is eliminated (see, for example, paragraphs 0062 to 0069 in the specification of Japanese Patent Application Laid-open No. 2011-154237).

SUMMARY

As shown in the description of Japanese Patent Application Laid-open Nos. 2012-155953 and 2011-154237, various techniques to display an image with a high quality are desired.

In view of the circumstances as described above, it is desirable to provide a signal processing method that is capable of displaying an image with a high quality, a display device, and an electronic apparatus.

According to an embodiment of the present disclosure, there is provided a signal processing method including inputting a first gradation signal and a second gradation signal, the first gradation signal representing a gradation of a predetermined pixel in a first frame, the second gradation signal representing a gradation of the predetermined pixel in a second frame that follows the first frame. Whether or not the gradation of the predetermined pixel in the first frame is a low gradation is determined based on the input first gradation signal. One of a first signal voltage and a second signal voltage is adjusted in a case where the determination result is positive, the first signal voltage defining a light-emitting brightness of a light-emitting pixel corresponding to the predetermined pixel in the first frame, the second signal voltage defining a light-emitting brightness of the light-emitting pixel in the second frame.

Accordingly, it is possible to reduce the problem caused due to the transition of gradation from the low gradation in each pixel of a frame. As a result, it is possible to display an image with a high quality.

The adjusting may include one of adjusting the input first gradation signal to generate a signal voltage corresponding to the adjusted first gradation signal as the first signal voltage and adjusting the input second gradation signal to generate a signal voltage corresponding to the adjusted second gradation signal as the second signal voltage.

The first or second signal voltage may be adjusted by adjusting the gradation signal in this way.

The adjusting may include one of adjusting a signal voltage corresponding to the input first gradation signal to generate the first signal voltage and adjusting a signal voltage corresponding to the input second gradation signal to generate the second signal voltage.

As described above, the signal voltage corresponding to the gradation signal may be adjusted. For example, a signal voltage is generated corresponding to the gradation signal, and the generated signal voltage is adjusted. Alternatively, the value of a signal voltage corresponding to the gradation signal may be changed.

The signal processing method may further include storing a flag corresponding to the result obtained by the determining. In this case, the adjusting may include performing adjustment based on the stored flag.

Accordingly, it is possible to reduce the necessary amount of memory.

The low gradation may represent a gradation in a range from a 0 gradation to a predetermined gradation. In this case, the adjusting may include adjusting the second signal voltage.

By adjusting the second signal voltage, it is possible to display an image with a high quality.

The adjusting may include adjusting the second signal voltage based on a light-emitting duty of a light-emitting element arranged as the light-emitting pixel.

By performing adjustment based on a light-emitting duty, it is possible to display an image with a high quality.

The low gradation may be a 0 gradation. In this case, the adjusting may include adjusting the first signal voltage to be a signal voltage closer to a signal voltage corresponding to a high gradation than a signal voltage corresponding to the 0 gradation.

By adjusting the first signal voltage, it is possible to display an image with a high quality.

The determining may include determining whether or not the gradation of the predetermined pixel in the second frame is larger than a predetermined gradation based on the second gradation signal. In this case, the adjusting may include performing adjustment in a case where the result obtained by the determining is positive.

By performing adjustment based on the gradation of the second frame, it is possible to display an image with a high quality.

The determining may include determining whether or not the gradation of the predetermined pixel in the first frame is the low gradation and a calculated gradation is in a range from a 0 gradation to a predetermined range, the calculated gradation being calculated based on gradations of at least one surrounding pixel in the first frame, the at least one surrounding pixel being arranged around the predetermined pixel. In this case, the adjusting may include performing adjustment in a case where the result obtained by the determining is positive.

By performing determination using the gradation of an adjacent pixel in this way, it is possible to perform adjustment with a high accuracy and to display an image with a high quality.

The determining may include performing determination using, as the calculated gradation, values obtained by applying weights to the gradations of the predetermined pixel and the at least one surrounding pixel in the first frame and summing the weighted values.

Accordingly, it is possible to perform adjustment with a high accuracy and to display an image with a high quality.

The predetermined pixel may be a sub-pixel constituting a unit pixel. In this case, the at least one surrounding pixel may be at least one sub-pixel constituting the same unit pixel together with the predetermined pixel.

As the at least one surrounding pixel, another sub-pixel constituting the same unit pixel may be used.

The at least one surrounding pixel may be at least one adjacent pixel adjacent to the predetermined pixel.

As the at least one surrounding pixel, an adjacent pixel may be used.

According to an embodiment of the present disclosure, there is provided a signal processing method including inputting a first gradation signal and a second gradation signal, the first gradation signal representing a gradation of a predetermined pixel in a first frame, the second gradation signal representing a gradation of the predetermined pixel in a second frame that follows the first frame. In a case where the input first gradation signal is a signal corresponding to black display and the input second gradation signal is a signal corresponds to white display, one of a first signal voltage and a second signal voltage is adjusted so that the first signal voltage is caused to be closer to a signal voltage corresponding to the white display and the second signal voltage is caused to be closer to a signal voltage corresponding to the black display, the first signal voltage defining a light-emitting brightness of a light-emitting pixel corresponding to the predetermined pixel in the first frame, the second signal voltage defining a light-emitting brightness of the light-emitting pixel in the second frame.

Accordingly, it is possible to reduce the problem caused due to the transition of gradation from the white display to the black display in each pixel of a frame. As a result, it is possible to display an image with a high quality.

According to an embodiment of the present disclosure, there is provided a display device including a display unit, an input unit, a determination unit, and an adjustment unit. The display unit includes a plurality of light-emitting pixels arranged in a two-dimensional form. The input unit is configured to input a first gradation signal and a second gradation signal, the first gradation signal representing a gradation of a predetermined pixel in a first frame, the second gradation signal representing a gradation of the predetermined pixel in a second frame that follows the first frame. The determination unit is configured to determine whether or not the gradation of the predetermined pixel in the first frame is a low gradation based on the input first gradation signal. The adjustment unit is configured to adjust one of a first signal voltage and a second signal voltage in a case where the determination result is positive, the first signal voltage defining a light-emitting brightness of a light-emitting pixel corresponding to the predetermined pixel in the first frame, the second signal voltage defining a light-emitting brightness of the light-emitting pixel in the second frame.

According to an embodiment of the present disclosure, there is provided an electronic apparatus including the display device.

As described above, according to the present disclosure, it is possible to display an image with a high quality. It should be noted that the effects described above are not necessarily restrictive, and may be any of those described in the present disclosure.

These and other objects, features and advantages of the present disclosure will become more apparent in light of the following detailed description of best mode embodiments thereof, as illustrated in the accompanying drawings.

BRIEF DESCRIPTION OF DRAWINGS

FIGS. 9A to 9C are each a diagram showing an example of an LUT used in the adjustment step;

FIGS. 18A and 18B are each a perspective view showing the appearance of an application example of the display device according to the embodiment; and FIG. 19 is a diagram showing the appearance of another application example of the display device according to the embodiment.

DETAILED DESCRIPTION OF EMBODIMENTS

Hereinafter, an embodiment of the present disclosure will be described with reference to the drawings.

(Configuration of Display Device)

Figure 1:
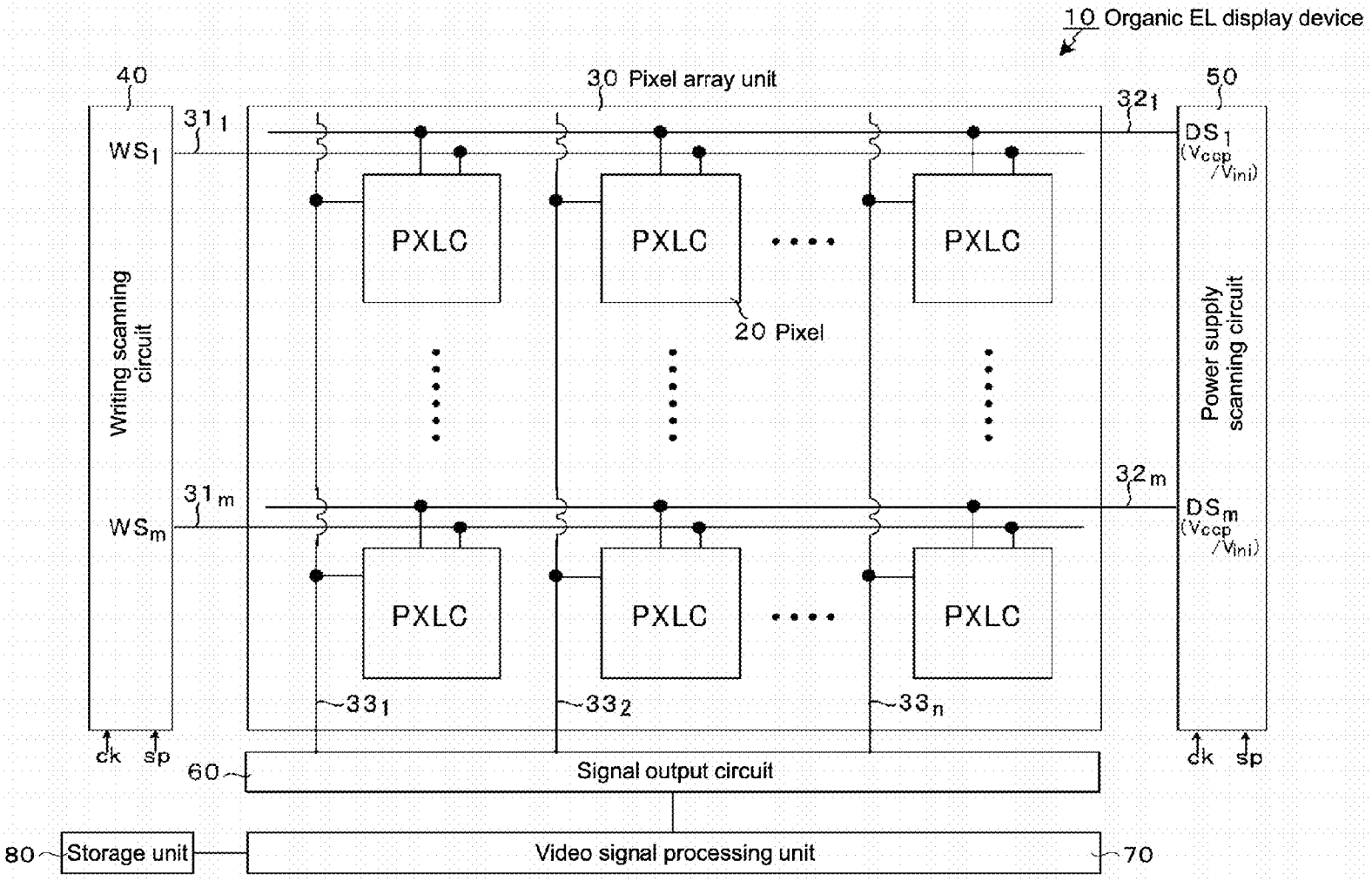
FIG. 1 is a schematic diagram showing a configuration example of a display device according an embodiment of the present disclosure.

FIG. 1 is a schematic diagram showing a configuration example of a display device according to an embodiment of the present disclosure. In this embodiment, as the display device, an active matrix type organic EL display device is used.

The active matrix type organic EL display device is a display device that controls a current flowing through the organic EL element being a current drive type light-emitting element by the active element provided in the same pixel as that of the organic EL element, e.g., insulated gate field effect transistor. As the insulated gate field effect transistor, a thin-film transistor (TFT) is typically used.

As shown in FIG. 1, an organic EL display device 10 according to this embodiment includes a plurality of pixels 20, a pixel array unit 30, a drive circuit unit, a video signal processing unit 70, and a storage unit 80. Each of the plurality of pixels 20 includes an organic EL element, the pixel array unit 30 includes the pixels 20 arranged in a two-dimensional matrix form, and the drive circuit unit is arranged around the pixel array unit 30.

The drive circuit unit includes a writing scanning circuit 40, a power supply scanning circuit 50, and a signal output circuit 60, and is configured to drive each pixel 20 of the pixel array unit 30. The video signal processing unit 70 is configured to supply a signal voltage corresponding to a video signal to the signal output circuit 60.

It should be noted that in the case where the organic EL display device 10 performs color display, one pixel (unit pixel) being a unit for forming a color image includes a plurality of sub-pixels, and each of the sub-pixels corresponds to the pixel 20 shown in FIG. 1. For example, the one pixel includes three pixels, i.e., a sub-pixel that emits red (R) light, a sub-pixel that emits green (G) light, and a sub-pixel that emits blue (B) light.

It should be noted that the one pixel is not limited to the combination of sub-pixels of three primary colors, i.e., RGB. The one pixel may include a sub-pixel of one or more colors as well as the sub-pixels of three primary colors. For example, a sub-pixel that emits white (W) light may be added to improve the brightness, or at least one sub-pixel that emits complementary color light may be added to enlarge the color reproduction range.

In the pixel array unit 30, scanning lines $\mathbf{31}_1$ to $\mathbf{31}_m$, power supply lines $\mathbf{32}_1$ to $\mathbf{32}_m$, and signal lines $\mathbf{33}_1$ to $\mathbf{33}_n$ are disposed on the pixels 20 arranged in m rows and n columns. The scanning lines $\mathbf{31}_1$ to $\mathbf{31}_m$ and the power supply lines $\mathbf{32}_1$ to $\mathbf{32}_m$ are disposed for each pixel row along the row direction (direction in which pixels in the pixel row are arranged). The signal lines $\mathbf{33}_1$ to $\mathbf{33}_n$ are disposed for each pixel column along the column direction (direction in which pixels in the pixel column are arranged).

The scanning lines $\mathbf{31}_1$ to $\mathbf{31}_m$ are connected to output terminals of corresponding rows in the writing scanning circuit 40. The power supply lines $\mathbf{32}_1$ to $\mathbf{32}_m$ are connected to output terminals of corresponding rows in the power supply scanning circuit 50. The signal lines $\mathbf{33}_1$ to $\mathbf{33}_n$ are connected to output terminals of corresponding columns in the signal output circuit 60.

The pixel array unit 30 is typically formed on a transparent insulating substrate such as a glass substrate. Accordingly, the organic EL display device 10 has a flat panel structure. The drive circuit of each pixel 20 of the pixel array unit 30 can be formed using an amorphous silicon TFT or a low temperature polysilicon TFT.

The writing scanning circuit 40 and the power supply scanning circuit 50 each include a shift register circuit that shifts (transfers) a start pulse sp in synchronization with a clock pulse ck, for example. The writing scanning circuit 40 is configured to sequentially supply writing scanning signals WS ($WS_1$ to $WS_m$) to the scanning lines 31 ($\mathbf{31}_1$ to $\mathbf{31}_m$) when writing a signal voltage corresponding to a video signal to each pixel 20 of the pixel array unit 30. Specifically, each pixel 20 of the pixel array unit 30 is scanned row by row in order (line sequential scanning).

The power supply scanning circuit 50 is configured to supply, to the power supply lines 32 ($\mathbf{32}_1$ to $\mathbf{32}_m$), power potentials DS ($DS_1$ to $DS_m$) that is capable of switching between a first power potential Vccp and a second power potential Vini in synchronization with the line sequential scanning performed by the writing scanning circuit 40. The second power potential Vini is lower than the first power potential Vccp. As will be described later, light emission/non-light emission of the pixels 20 is controlled by the switching between Vccp/Vini of the power potential DS.

The signal output circuit 60 is configured to selectively output a signal voltage Vsig corresponding to a video signal supplied from the video signal processing unit 70 (hereinafter, referred to as simply "signal voltage" in some cases) and a reference voltage Vofs. It should be noted that the reference voltage Vofs is a voltage being a reference of the signal voltage Vsig of a video signal (e.g., potential corresponding to the black level of a video signal), and is used at the time of the threshold correction process to be described later.

The signal voltage Vsig/reference voltage Vofs output from the signal output circuit 60 is written in a unit of the pixel row selected by the scanning performed by the writing scanning circuit 40, through the signal lines 33 ($\mathbf{33}_1$ to $\mathbf{33}_n$).

Specifically, the signal output circuit 60 has a drive configuration of line sequential writing in which the signal voltage Vsig is written for each row (line).

The video signal processing unit 70 is capable of performing a predetermined process such as a gamma correction on a video signal input from the outside or the like. For example, as a digital video signal, a plurality of image signals corresponding to a plurality of sequential frames are input. The image signal includes a gradation signal that represents the gradation of each pixel of a frame. The gradation signal is a signal input corresponding to each pixel. An analog video signal may be input from the outside. In this case, the video signal processing unit 70 appropriately samples a video signal, and thus, an image signal is generated for each frame.

The video signal processing unit 70 is configured to generate, based on the image signal of each frame, the signal voltage Vsig for displaying the frame. The signal voltage Vsig is a signal that defines the light-emitting brightness of each light-emitting pixel, and is generated depending on the gradation signal of each pixel in the image signal. The signal voltage Vsig is supplied to the signal output circuit 60 at a predetermined timing for displaying a frame. In this embodiment, the signal voltage corresponding to a video signal corresponds to the signal voltage corresponding to an image signal for each frame (signal voltage corresponding to a gradation signal).

In this embodiment, the video signal processing unit 70 performs a signal processing method according to the embodiment of the present disclosure. Specifically, the signal voltage Vsig is appropriately adjusted in each pixel 20 (at least predetermined pixel). This will be described later in detail.

It should be noted that in this embodiment, the plurality of pixels 20, the pixel array unit 30, and the drive circuit unit constitute a display unit including a plurality of pixels arranged in a two-dimensional form. Moreover, each of the pixels 20 corresponds to the light-emitting pixel.

The storage unit 80 includes a read only memory (ROM), a hard disk drive (HDD), or the like, and is configured to function as a frame memory. In addition, the storage unit 80 is configured to store a look-up table (LUT) used for gradation adjustment to be described later.

Figure 2:
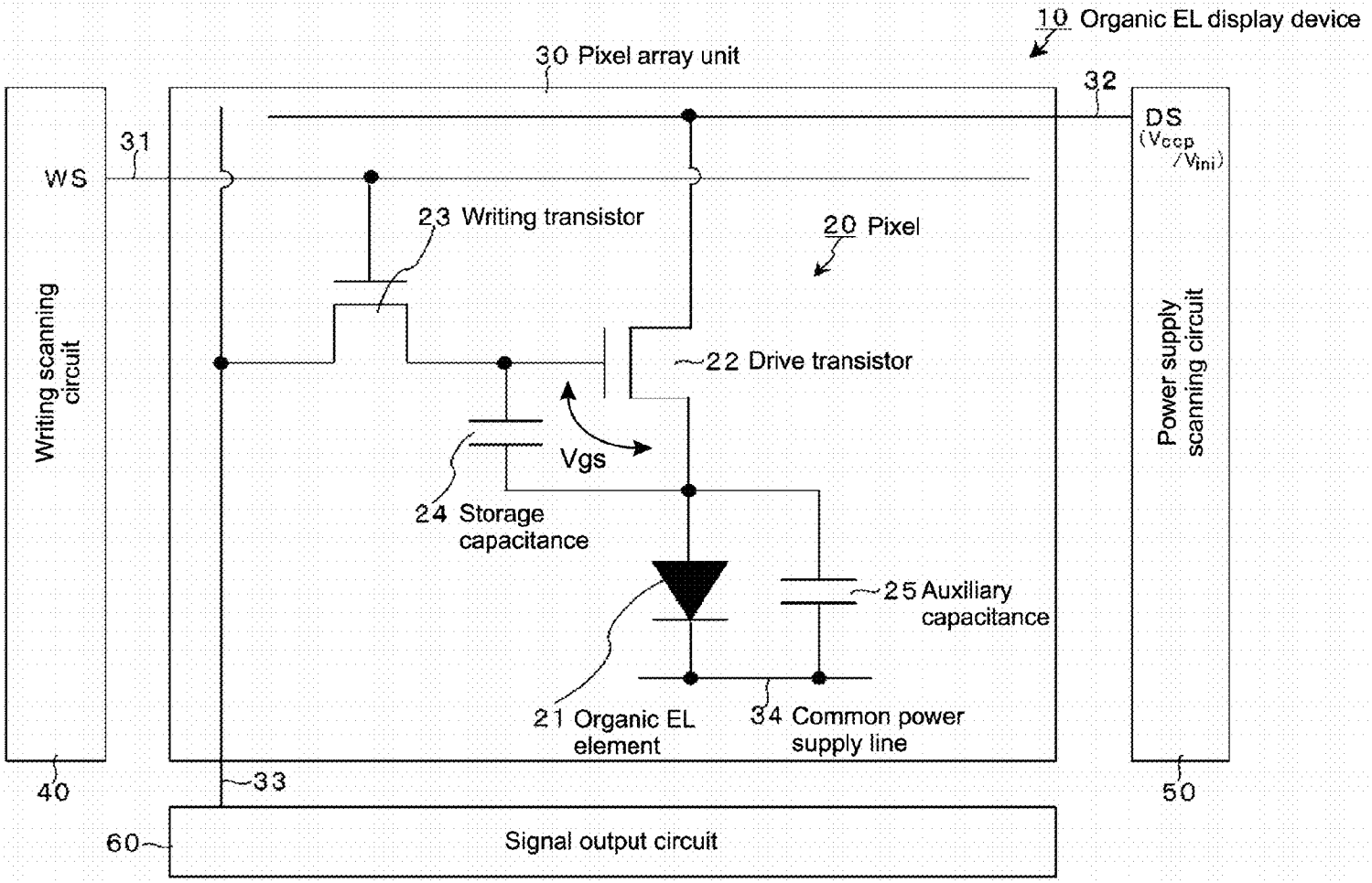
FIG. 2 is a circuit diagram showing an example of a specific circuit configuration of a pixel (pixel circuit)

FIG. 2 is a circuit diagram showing an example of a specific circuit configuration of the pixel (pixel circuit) 20. The light-emitting unit of the pixel 20 includes an organic EL element 21 being a current drive type light-emitting element in which the light-emitting brightness varies depending on the value of a current flowing through the device.

As shown in FIG. 2, the pixel 20 includes the organic EL element 21 and a drive circuit that drives the organic EL element 21 by causing a current to flow through the organic EL element 21. The organic EL element 21 typically has a configuration in which an anode electrode, an organic layer, and a cathode electrode are laminated in order.

The drive circuit that drives the organic EL element 21 includes a drive transistor 22, a writing transistor 23, a storage capacitance 24, and an auxiliary capacitance 25. As the drive transistor 22 and the writing transistor 23, an N-channel TFT can be used, for example. It should be noted that the combination of the conductive types of the drive transistor 22 and the writing transistor 23 described herein is merely an example, and is not limited thereto.

One electrode (source/drain electrode) of the drive transistor 22 is connected to the anode electrode of the organic EL element 21, and the other electrode (drain/source electrode) of the drive transistor 22 is connected to the power supply lines 32 ($\mathbf{32}_1$ to $\mathbf{32}_m$).

One electrode (source/drain electrode) of the writing transistor 23 is connected to the signal lines 33 ($\mathbf{33}_1$ to $\mathbf{33}_n$), and the other electrode (drain/source electrode) of the writing transistor 23 is connected to the gate electrode of the drive transistor 22. Moreover, the gate electrode of the writing transistor 23 is connected to the scanning lines 31 ($\mathbf{31}_1$ to $\mathbf{31}_m$).

In the drive transistor 22 and the writing transistor 23, the one electrode represents a metal wiring electrically connected to a source/drain area, and the other electrode represents a metal wiring electrically connected to a drain/source area. Moreover, the one electrode becomes a source electrode or a drain electrode, and the other electrode becomes a drain electrode or a source electrode, depending on the relationship between the potential of the one electrode and the potential of the other electrode.

One electrode of the storage capacitance 24 is connected to the gate electrode of the drive transistor 22, and the other electrode of the storage capacitance 24 is connected to the other electrode of the drive transistor 22 and the anode electrode of the organic EL element 21.

One electrode of the auxiliary capacitance 25 is connected to the anode electrode of the organic EL element 21, and the other electrode of the auxiliary capacitance 25 is connected to a common power supply line 34. The auxiliary capacitance 25 is configured to compensate for insufficient capacitance of the organic EL element 21 and is provided as necessary to increase the writing gain of the signal voltage to the storage capacitance 24. It should be noted that the other electrode of the auxiliary capacitance 25 may be connected to another node having a fixed potential, which is different from the common power supply line 34.

In the pixel 20 having the above-mentioned configuration, the writing transistor 23 is caused to be in a conduction state in response to a high-active writing scanning signal WS applied to the gate electrode from the writing scanning circuit 40 through the scanning line 31. Accordingly, the writing transistor 23 samples the signal voltage Vsig or the reference voltage Vofs corresponding to the video signal, which is supplied from the signal output circuit 60 through the signal line 33, and writes the sampled voltage to the pixel 20. The written signal voltage Vsig or reference voltage Vofs is applied to the gate electrode of the drive transistor 22 and is stored in the storage capacitance 24.

In the case where the power supply potential DS of the power supply lines 32 ($\mathbf{32}_1$ to $\mathbf{32}_m$) is the first power supply potential Vccp, one electrode of the drive transistor 22 becomes a drain electrode, the other electrode of the drive transistor 22 becomes a source electrode, and the drive transistor 22 operates in a saturation area. Accordingly, the drive transistor 22 receives current supply from the power supply line 32, and supplies a drive current to the organic EL element 21. The current value of the drive current is a value corresponding to the signal voltage Vsig stored in the storage capacitance 24. As a result, the organic EL element 21 emits light with a brightness (gradation) corresponding to the video signal.

In the case where the power potential DS is switched from the first power potential Vccp to the second power potential Vini, one electrode of the drive transistor 22 becomes a source electrode, the other electrode of the drive transistor 22 becomes a drain electrode, and the drive transistor 22 operates as a switching transistor. Accordingly, the drive transistor 22 stops supplying the drive current to the organic EL element 21, and causes the organic EL element 21 to be in a non-light emission state. Specifically, the drive transistor 22 has also a function of a transistor that controls the light emission/non-light emission of the organic EL element 21.

With the switching operation of the drive transistor 22, it is possible to set a period in which the organic EL element 21 is in a non-light emission state (non-light emission period), and to control the proportion (duty) of the light emission period to the non-light emission period of the organic EL element 21. With the duty control, it is possible to reduce the after-image blur caused due to the light emission of a pixel over one display frame. Thus, it is possible to improve the quality of a movie, particularly.

Of the first and second power potentials Vccp and Vini selectively supplied from the power supply scanning circuit 50 through the power supply line 32, the first power potential Vccp is a power potential for supplying, to the drive transistor 22, a drive current that causes the organic EL element 21 to drive light emission. Moreover, the second power potential Vini is a power potential for applying a reverse bias to the organic EL element 21. The second power potential Vini is set to a potential lower than the reference voltage Vofs. For example, if the threshold voltage of the drive transistor 22 is assumed to be Vth, the second power potential Vini is set to a potential significantly lower than Vofs−Vth.

(Basic Circuit Operation)

The basic circuit operation of the organic EL display device 10 having the above-mentioned configuration will be described with reference to the timing waveform chart of FIG. 3. The timing waveform chart of FIG. 3 shows the respective changes in the potential (writing scanning signal) WS of the scanning line 31, the potential (power potential) DS of the power supply line 32, the potential (Vsig/Vofs) of the signal line 33, a gate potential Vg of the drive transistor 22, and a source potential Vs of the drive transistor 22.

Figure 3:
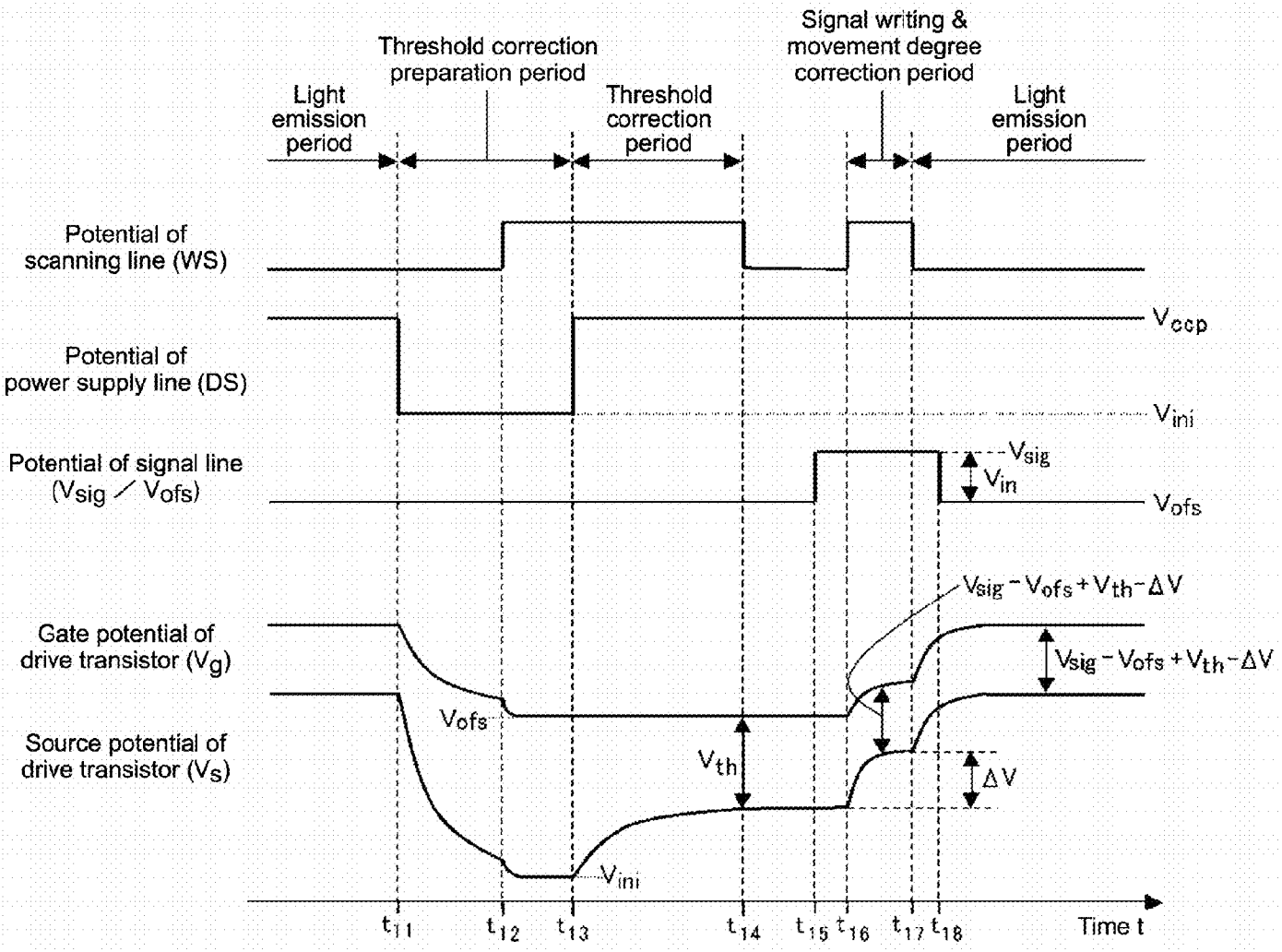
FIG. 3 is a timing waveform chart for explaining an example of a basic circuit operation of the display device.

In the timing waveform chart of FIG. 3, the period before a time $t_{11}$ is a period in which the organic EL element 21 emits light in the previous display frame. In the light emission period in the previous display frame, the potential DS of the power supply line 32 is the first power potential (hereinafter, referred to as "high potential") Vccp, and the writing transistor 23 is in a non-conduction state.

At this time, the drive transistor 22 is designed to operate in a saturation area. Accordingly, the drive current (drain-source current) corresponding to a gate-source voltage Vgs of the drive transistor 22 (see FIG. 2) is supplied from the power supply line 32 to the organic EL element 21 through the drive transistor 22. As a result, the organic EL element 21 emits light with a brightness (gradation) corresponding to the current value of the drive current.

At the time of the time $t_{11}$, a new display frame (current display frame) of the line sequential scanning starts. Then, the potential DS of the power supply line 32 is switched from the high potential Vccp to the second power potential Vini that is significantly lower than Vofs−Vth (hereinafter, referred to as "low potential").

Here, the threshold voltage of the organic EL element 21 is referred to as threshold voltage Vthel, and a potential (cathode potential) of the common power supply line 34 is referred to as potential Vcath. At this time, if the low potential Vini satisfies the relationship of Vini<Vthel+Vcath, the source potential Vs of the drive transistor 22 almost equals to the low potential Vini. Therefore, the organic EL element 21 is in a reverse bias state, and extinguishes light.

Next, at the time of a time $t_{12}$, the potential WS of the scanning line 31 changes from the low potential to the high potential. Thus, the writing transistor 23 is caused to be in a conduction state. At this time, because the reference voltage Vofs has been supplied from the signal output circuit 60 to the signal line 33, the gate potential Vg of the drive transistor 22 is the reference voltage Vofs. Moreover, the source potential Vs of the drive transistor 22 is a potential significantly lower than the reference voltage Vofs, i.e., the low potential Vini.

At this time, the gate-source voltage Vgs of the drive transistor 22 is represented by Vofs−Vini. In order to perform the threshold correction process to be described later, the Vofs−Vini needs to be larger than the threshold voltage Vth of the drive transistor 22. Therefore, each potential is set so as to satisfy the relationship of Vofs−Vini>Vth.

As described above, the process of fixing (defining) the gate potential Vg and the source potential Vs of the drive transistor 22 to the reference voltage Vofs and the low potential Vini, respectively, for initialization, is a preparation (threshold correction preparation) process before the threshold correction process to be described later (threshold correction operation) is performed. Therefore, the reference voltage Vofs and the low potential Vini are initialization potentials of the gate potential Vg and the source potential V of the drive transistor 22, respectively.

Next, at the time of a time $t_{13}$, if the potential DS of the power supply line 32 is switched from the low potential Vini to the high potential Vccp, the threshold correction process is started in the state where the gate potential Vg of the drive transistor 22 is maintained in the reference voltage Vofs. Specifically, the source potential Vs of the drive transistor 22 starts to increase towards the potential obtained by subtracting the threshold voltage Vth from the gate potential Vg.

It should be noted that the initialization potential Vofs of the gate potential Vg of the drive transistor 22 is used as a reference, and the process of changing the source potential Vs towards the potential obtained by subtracting the threshold voltage Vth of the drive transistor 22 from the initialization potential Vofs is referred to as the threshold correction process for the sake of convenience. When the threshold correction process proceeds, the gate-source voltage Vgs of the drive transistor 22 converges to the threshold voltage Vth of the drive transistor 22. The voltage corresponding to the threshold voltage Vth is stored in the storage capacitance 24.

It should be noted that the potential Vcath of the common power supply line 34 is set so that the organic EL element 21 is in a cut-off state in the period in which the threshold correction process is performed (threshold correction period). Therefore, the current from the drive transistor 22 flows to the storage capacitance 24 but not to the organic EL element 21.

As described above, the threshold correction process is performed over the period from the time $T_{13}$ to the time $T_{14}$. Accordingly, the drain-source current supplied from the drive transistor 22 to the organic EL element 21 can have a value that does not depend on the threshold voltage Vth of the drive transistor 22. As a result, even if the threshold voltage Vth of the drive transistor 22 varies for each pixel due to the variability of the manufacturing process or time degradation of the drive transistor 22, the drain-source current does not vary. Therefore, it is possible to maintain a constant light emission gradation of the organic EL element 21.

Next, at the time of the time $t_{14}$, the potential WS of the scanning line 31 changes to the low potential, and thus, the writing transistor 23 is caused to be in a non-conduction state. At this time, the gate electrode of the drive transistor 22 is electrically cut off from the signal line 33, and thus is in a floating state. However, because the gate-source voltage Vgs equals to the threshold voltage Vth of the drive transistor 22, the drive transistor 22 is in a cut off state. Therefore, the drain-source current does not flow to the drive transistor 22.

Next, at the time of a time $t_{15}$, the potential of the signal line 33 is switched from the reference voltage Vofs to the signal voltage Vsig corresponding to the video signal. Next, at the time of a time $t_{16}$, the potential WS of the scanning line 31 changes to the high potential. Thus, the writing transistor 23 is caused to be in a conduction state, and the signal voltage Vsig corresponding to the video signal is sampled and is written to the pixel 20.

By the writing of the signal voltage Vsig by the writing transistor 23, the gate potential Vg of the drive transistor 22 is the signal voltage Vsig. Then, when the drive transistor 22 is driven by the signal voltage Vsig corresponding to the video signal, the threshold voltage Vth of the drive transistor 22 is cancelled out by a voltage corresponding to the threshold voltage Vth stored in the storage capacitance 24. Accordingly, the drain-source current has a value that does not depend on the threshold voltage Vth.

At this time, the organic EL element 21 is in a cut off state (high-impedance state). Therefore, the current flowing from the power supply line 32 to the drive transistor 22 (drain-source current) in response to the signal voltage Vsig corresponding to the video signal flows to an equivalent capacitance of the organic EL element 21 and the auxiliary capacitance 25. Accordingly, the equivalent capacitance of the organic EL element 21 and the auxiliary capacitance 25 are started to be charged.

The equivalent capacitance of the organic EL element 21 and the auxiliary capacitance 25 are charged, and thus, the source potential Vs of the drive transistor 22 increases with time. At this time, the variability of the threshold voltage Vth of the drive transistor 22 for each pixel is already canceled, and the drain-source current of the drive transistor 22 depends on the degree of movement μ of the drive transistor 22. It should be noted that the degree of movement μ of the drive transistor 22 is the degree of movement of a semiconductor thin film constituting the channel of the drive transistor 22.

Here, the ratio of a holding voltage Vgs of the storage capacitance 24 to the signal voltage Vsig corresponding to the video signal, i.e., writing gain G is assumed to be 1 (ideal value). As a result, the source potential Vs of the drive transistor 22 increases up to the potential represented by Vofs−Vth+ΔV. Thus, the gate-source voltage Vgs of the drive transistor 22 is represented by Vsig−Vofs+Vth−ΔV.

Specifically, the increase ΔV in the source potential Vs of the drive transistor 22 is subtracted from the voltage (Vsig−Vofs+Vth) stored in the storage capacitance 24, i.e., electrical charges of the storage capacitance 24 are discharged. In other words, a negative feedback of the increase ΔV in the source potential Vs is applied to the storage capacitance 24. Therefore, the increase AV in the source potential Vs has a feedback amount of negative feedback.

As described above, by applying negative feedback to the gate-source voltage Vgs in the feedback amount ΔV corresponding to the drain-source current flowing through the drive transistor 22, it is possible to cancel out the dependency of the drain-source current of the drive transistor 22 on the degree of movement μ. This cancelling process is the movement degree correction process for correcting the variability in the degree of movement μ of the drive transistor 22 for each pixel. More specifically, the drain-source current increases with a larger signal amplitude Vin (=Vsig−Vofs) of a signal written to the gate electrode of the drive transistor 22. Therefore, the absolute value of the feedback amount ΔV of negative feedback also increases. Therefore, it is possible to perform the movement degree correction process depending on the level of a light emission gradation.

Next, at the time of a time $t_{17}$, the potential WS of the scanning line 31 changes to the low potential, and thus, the writing transistor 23 is caused to be in a non-conduction state. Accordingly, the gate electrode of the drive transistor 22 is electrically cut off from the signal line 33, and thus is in a floating state.

Because the storage capacitance 24 is connected between the gate and source of the drive transistor 22, the gate potential Vg changes in synchronization with the change in the source potential Vs of the drive transistor 22 in the case where the gate electrode of the drive transistor 22 is in a floating state. As described above, the operation in which the gate potential Vg of the drive transistor 22 changes in synchronization with the changes in the source potential Vs is a bootstrap operation performed by the storage capacitance 24.

The gate electrode of the drive transistor 22 is caused to be in a floating state, and the drain-source current of the drive transistor 22 starts to flow to the organic EL element 21 at the same time. Thus, the anode potential of the organic EL element 21 increases depending on the current.

Then, when the anode potential of the organic EL element 21 exceeds Vthel+Vcath, a drive current starts to flow to the organic EL element 21 and the organic EL element 21 starts to emit light. Moreover, the increase in the anode potential of the organic EL element 21 represents the increase in the source potential Vs of the drive transistor 22. When the source potential Vs of the drive transistor 22 increases, the gate potential Vg of the drive transistor 22 increases in synchronization therewith by the bootstrap operation performed by the storage capacitance 24

At this time, if the bootstrap gain is assumed to have a value of 1 (ideal value), the amount of increase in the gate potential Vg equals to the increase in the source potential Vs. Therefore, in the light emission period, the gate-source voltage Vgs of the drive transistor 22 is maintained constant at Vsig−Vofs+Vth−ΔV. Then, at the time of a time $t_{18}$, the potential of the signal line 33 is switched from the signal voltage Vsig corresponding to the video signal to the reference voltage Vofs.

In the series of circuit operation described above, the process operations of the threshold correction preparation, the threshold correction, the writing of the signal voltage Vsig, and the movement degree correction are performed in one horizontal scanning period (1H). Moreover, the process operations of the signal writing and the movement degree correction are performed in parallel in the period from the time $t_{16}$ to $t_{17}$.

(Video Signal Processing Unit and Signal Processing Method)

Figure 4:
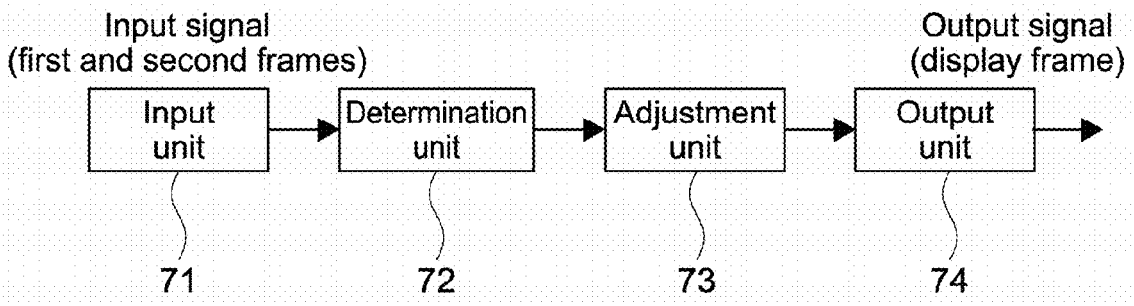
FIG. 4 is a schematic diagram showing a configuration example of a video signal processing unit.

FIG. 4 is a schematic diagram showing a configuration example of the video signal processing unit 70 according to this embodiment. The video signal processing unit 70 includes an input unit 71, a determination unit 72, an adjustment unit 73, and an output unit 74.

The input unit 71 is configured to input an image signal of each of a plurality of sequential frames. In particular, image signals of two sequential frames out of the plurality of frames are input. Specifically, in this embodiment, the first gradation signal that represents the gradation of the predetermined pixel in the first frame and the second gradation signal that represents the gradation of the predetermined pixel in the second frame that follows the first frame are input to the input unit 71. The predetermined pixel is typically each pixel in the frame. Hereinafter, the first frame is referred to as n−1 frame, and the second frame is referred to as n frame in some cases.

The determination unit 72 is configured to determine whether or not the gradation of the predetermined pixel in the first frame is a low gradation based on the input first gradation signal. Specifically, whether or not the gradation of a previous frame that is displayed first out of the two sequential frames is the low gradation is determined.

As the gradation, gradations of 8 bits from a 0 gradation to a 255 gradation are used, for example. However, the gradation is not limited thereto.

The adjustment unit 73 is configured to adjust the first signal voltage or the second signal voltage in the case where the results obtained by the determination performed by the determination unit 72 are positive. The first signal voltage defines the light-emitting brightness of the light-emitting pixel corresponding to the predetermined pixel in the first frame, and the second signal voltage defines the light-emitting brightness of the light-emitting pixel in the second frame.

In this embodiment, the adjustment unit 73 adjusts the input first gradation signal or the input second gradation signal. The signal voltage is generated depending on the gradation signal. Therefore, by adjusting the gradation signal, the signal voltage is adjusted. Specifically, the signal voltage corresponding to the adjusted first gradation signal is generated as the first signal voltage. Alternatively, the signal voltage corresponding to the adjusted second gradation signal is generated as the second signal voltage.

The output unit 74 is configured to output an image signal including the adjusted first gradation signal or an image signal including the adjusted second gradation signal as an image signal of a display frame to be displayed. Therefore, in the case where the first gradation signal is adjusted, the image signal including the first gradation signal is output as an image signal to be displayed. Conversely, the adjustment of the first gradation signal is a process performed when the first frame is displayed.

In the case where the second gradation signal is adjusted, the image signal including the second gradation signal is output as an image signal to be displayed. Conversely, the adjustment of the second gradation signal is a process performed when the second frame is displayed.

The specific circuit configuration or the like of each block shown in FIG. 1 is not limited. Moreover, different blocks may be achieved by one block. Furthermore, each block may be achieved as a software block. Specifically, hardware of the organic EL display device 10 and software stored in the storage unit 80 or the like may cooperate with each other to perform the signal processing method according to this embodiment.

Figure 5:
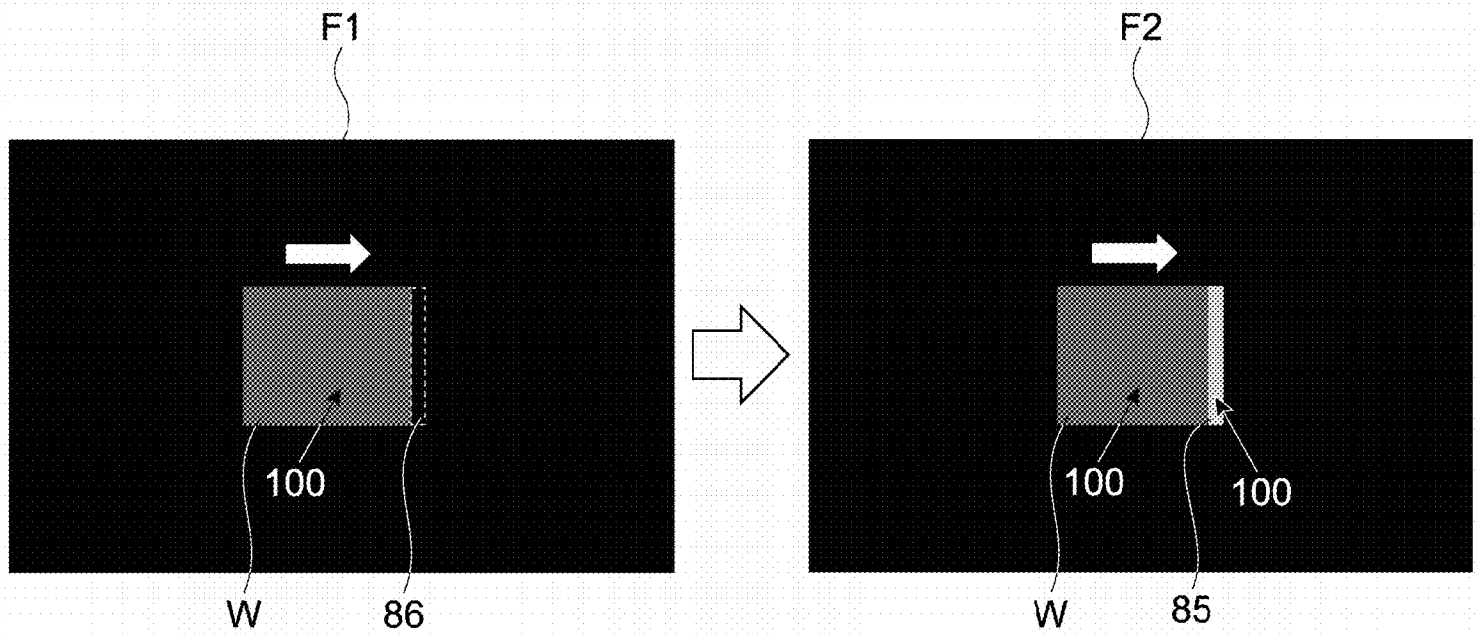
FIG. 5 is a schematic diagram showing an example of abnormal response of light emission at the time of a frame transition.

FIG. 5 is a schematic diagram showing an example of abnormal response of light emission. With verification performed by the inventors of the present disclosure, it has been found that, in the case where the light emission gradation changes from the vicinity of black (vicinity of 0 gradation) to a brighter gradation with the change of the frame, abnormal response may be generated in the changed frame.

For example, as shown in FIG. 5, a window W that emits light with a predetermined gradation (e.g., 100 gradation) is assumed to be displayed at the center of the first frame F1 with a background of black display (0 gradation). Then, the window W is scrolled to the right side. As a result, abnormal response is generated in an area 85 of the front portion of the window W in the second frame F2 in some cases. The area 85 of the front portion of the second frame F2 corresponds to an area 86 of one pixel adjacent to the window W in the first frame F1. In the case where the area 86 changes from black display to a 100 gradation, abnormal response is generated and light emission is performed with a gradation brighter than a 100 gradation.

Figure 6:
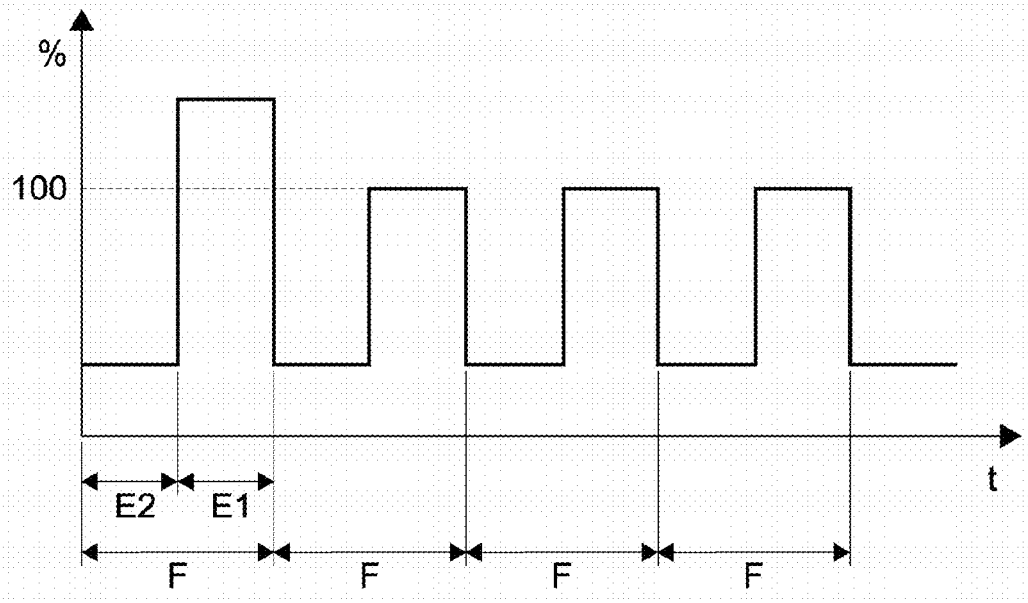
FIG. 6 is a graph showing the state in which the abnormal response of light emission is generated.

FIG. 6 is a graph showing the above-mentioned state in which the abnormal response of light emission is generated. This graph shows the relationship between the gradation of the pixel in the area 85 of the front portion of the second frame F2 and time.

The horizontal axis in the graph represents time and a period F represents one display frame period. In the example shown in FIG. 6, a light emission period E1 almost equals to a non-light emission period E2. Therefore, the light emission duty is about 50%. The vertical axis in the graph represents the normalized value of the gradation. The desired gradation with which light emission is desired to be performed, i.e., gradation in the image signal of a display frame is 100%. Therefore, in the example shown in FIG. 5, the 100 gradation represents the value of 100%.

In the graph, the first display frame period F corresponds to the display frame period of the second frame F2 shown in FIG. 5. It can be seen that light emission is performed with a gradation of more than the 100 gradation in the case of a change from the 0 gradation to the 100 gradation. In the following frame, light emission is properly performed with the 100 gradation depending on the scrolling of the window W.

In order to reduce the abnormal response of light emission shown in FIG. 5 and FIG. 6, the signal processing method according to an embodiment of the present disclosure is performed. Hereinafter, some embodiments of the signal processing method will be described. It should be noted that in the following description, the first image signal represents an image signal including the first gradation signal, and the second image signal represents an image signal including the second gradation signal. Moreover, the adjusted image signal represents an image signal including an adjusted gradation signal. Moreover, the adjustment of a gradation signal is referred as simply gradation adjustment in some cases.

(Signal Processing Method 1)

Figure 7:
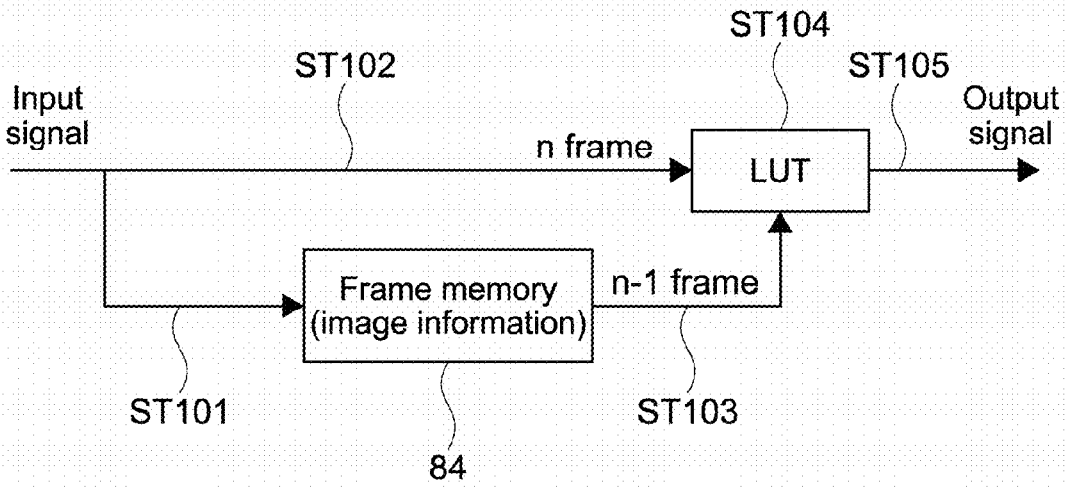
FIG. 7 is a flowchart showing an example of adjustment performed in a signal processing method according to an embodiment of the present disclosure.

FIG. 7 is a flowchart showing an example of adjustment performed in a signal processing method 1. The first image signal in the n−1 frame is stored in a frame memory 84 (Step 101). The second image signal in the n frame is input (Step 102). The first image signal in the n−1 frame is read from the frame memory 84 (Step 103). In each pixel, whether or not the gradation of the first frame is low gradation is determined based on the first image signal. Then, in the pixel that satisfies the determination conditions, the gradation of the second frame is adjusted based on a look-up table (Step 104). The adjusted second image signal is output as the image signal of a display frame (Step 105).

This adjustment example is also a process to correct the gradation of the second frame so that the second frame F2 is properly displayed. By correcting the gradation of the second frame, the second signal voltage is corrected.

The first image signal may be stored in the frame memory 84 as it is, or data obtained by compressing the first image signal by coding may be stored in the frame memory 84. As the coding, an arbitrary coding, e.g., block coding such as generalized block truncation coding (GBTC), and two dimensional discrete cosine transform coding such as joint photographic experts group (JPEG), may be used. When the first image signal is read, the compressed data may be appropriately decoded. By compressing data as described above, it is possible to reduce the amount of memory.

In this adjustment example, in the determination step, whether or not the gradation of the first frame is in the range from a 0 gradation to a predetermined gradation is determined. In the case where the gradation of the first frame is in the range, it is determined that the gradation of the first frame is the low gradation.

The above-mentioned abnormal response is often generated at the time of a change from a 0 gradation. However, the abnormal response is generated in a gradation close to 0 (e.g., gradation in the range from a 0 gradation to a 4 gradation) in some cases. The value varies depending on each device or circuit configuration of the manufactured display device, for example. Therefore, the range of a gradation in which the abnormal response is generated or the range of a gradation that needs to be adjusted is appropriately set in advance. Then, the range of the gradation (threshold value) is used as a reference to determine whether or not the gradation of the first frame is the low gradation.

Figure 8:
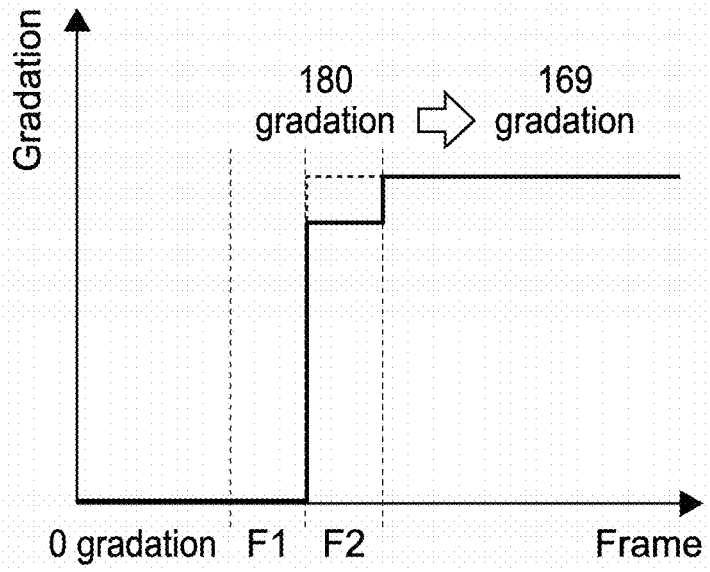
FIG. 8 is a graph showing an example of the process of adjustment step in the adjustment example shown in FIG. 7.

FIG. 8 is a graph showing an example of the process of the adjustment step in this adjustment example. In the graph, the horizontal axis represents positions of sequential frames, and the vertical axis represents the gradation. For example, it is assumed that light emission is performed with a gradation larger than a 180 gradation due to the abnormal response when the gradation of the predetermined pixel changes from a 0 gradation to a 180 gradation. In such a case, as shown in FIG. 8, the gradation of first one frame (second frame F2) after the change is corrected to a 169 gradation smaller than the 180 gradation. With such a process, it is possible to reduce the abnormal response.

FIG. 9 are each a diagram showing an example of the LUT used in the adjustment step. FIG. 9A shows the LUT in the case where the light-emitting duty of the organic EL element 21 arranged as the light-emitting pixel is 90%. FIG. 9B shows the LUT in the case where the light-emitting duty is 60%, and FIG. 9C shows the LUT in the case where the light-emitting duty is 30%.

In each LUT, the gradation of the input second frame F2 and the corrected gradation are stored as an argument and a corrected value, respectively. Regarding a gradation that is not stored in the LUT, a value corrected by linear interpolation or the like is output. It goes without saying that corrected values may be stored for all gradations.

In each LUT shown in FIG. 9, values up to about a 128 gradation are corrected to different gradations. Moreover, the correction amount is small in the case of the light emission duty of 60% as compared with the case of the light emission duty of 90%. Furthermore, in the case of the light emission duty of 30%, the correction is performed in the opposite direction, i.e., to increase the gradation.

The present inventors have found that the degree of the abnormal response, i.e., the amount of change in the gradation, varies depending on the light emission duty. In addition, the present inventors have found that the gradation of the second frame F2 can not only increase but also decrease due to the abnormal response. Based on the verification results, the LUT shown in each of FIG. 9 has been created as an example. By adjusting the gradation signal in the second image signal based on the light emission duty, it is possible to sufficiently reduce the abnormal response.

Moreover, in each LUT shown in FIG. 9, gradations larger than about a 128 gradation are not corrected. Specifically, some gradations need not to be corrected. The adjustment (correction) in this embodiment includes outputting the same gradation as the input gradation.

Similarly to the range (threshold value) of the gradation being a reference to perform the determination in the determination step, the LUT used in the adjustment step is appropriately created depending on each device or circuit configuration of the manufactured display device, the light emission duty, or the like. The range of the reference gradation and the LUT are typically set and created, respectively, for each series when the display device is designed and manufactured. However, the LUT or the like is not limited thereto, and may be appropriately created for each factory shipment of the product.

Figure 10B:
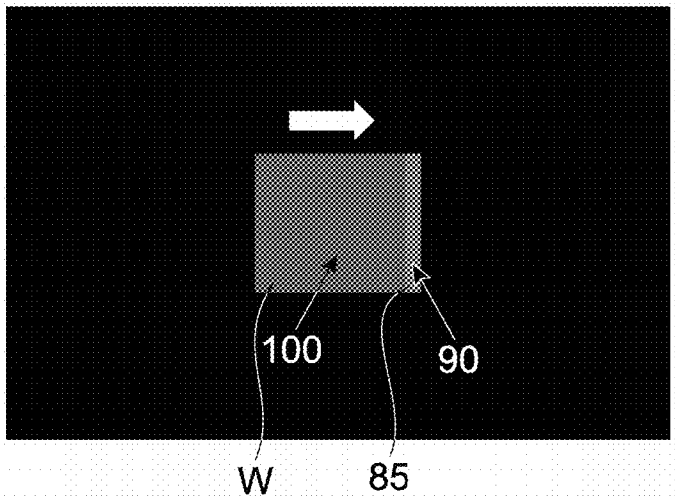
FIGS. 10A and 10B are each a schematic diagram for explaining the light emission state of a second frame F2 in the case where the signal processing method according to the embodiment is used.
Figure 10A:
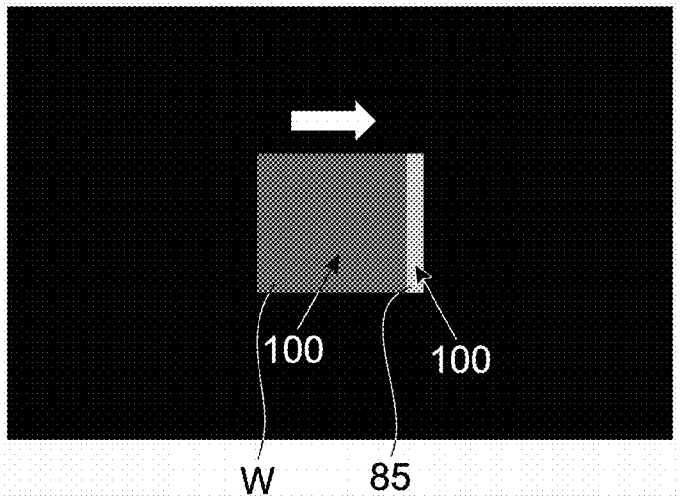

FIG. 10 are each a schematic diagram for explaining the light emission state of the second frame F2 in the case where the signal processing method according to this embodiment is used. As described above with reference to FIG. 5, it is assumed that the window W is scrolled to the right side. In FIG. 10A, the signal processing method according to this embodiment is not used, and the signal voltage corresponding to a 100 gradation is applied to the pixel in the area 85 on the front portion of the window W. As a result, the area 85 on the front portion emits light brightly.

In FIG. 10B, the gradation of the second frame F2 in the area 85 on the front portion is corrected by the signal processing method according to this embodiment. For example, the gradation is corrected from a 100 gradation to a 90 gradation by the correction, and the signal voltage corresponding to the gradation is applied. As a result, it is possible to sufficiently reduce the abnormal response. In FIG. 10B, the area 85 on the front portion emits light with a gradation slightly larger than a 100 gradation. By appropriately setting the correction amount, it is possible to cause the pixel in the area 85 to emit light with a 100 gradation.

(Signal Processing Method 2)

Figure 11:
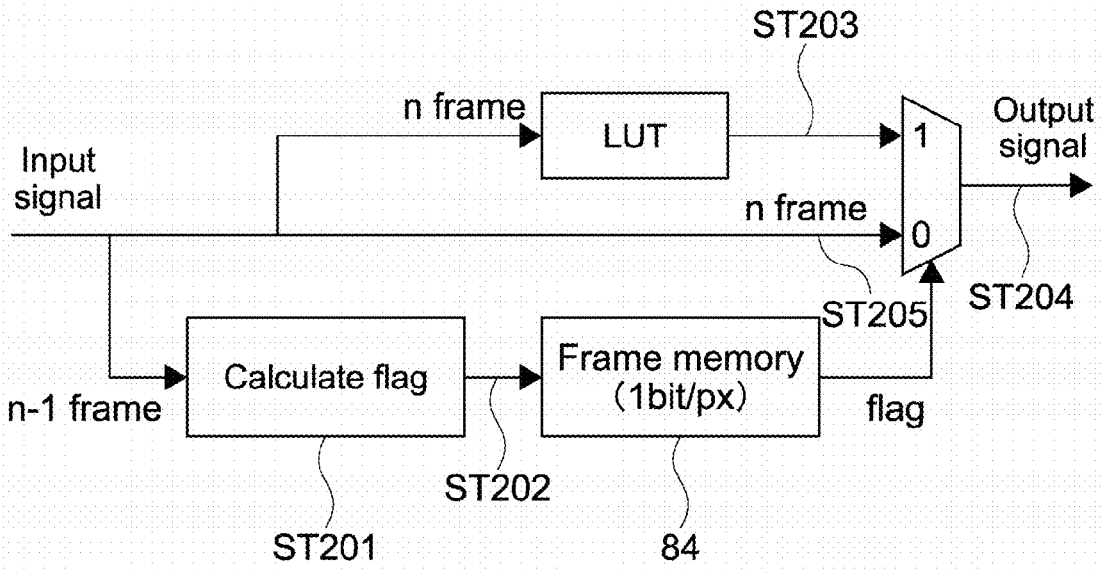
FIG. 11 is a flowchart showing another example of the adjustment performed in the signal processing method according to the embodiment.

FIG. 11 is a flowchart showing an example of the adjustment performed in a signal processing method 2. The determination unit 72 performs the determination on the first image signal in the n-1 frame. Then, a flag depending on the determination results for each pixel is calculated (Step 201). Specifically, "1 (on)" is set as a flag to the pixel in which the gradation of the first frame is determined to be the low gradation. Moreover, "0 (off)" is set as a flag to the pixel in which the gradation of the first frame is not the low gradation.

Information on the flag for the pixel is stored in the frame memory 84 (Step 202). Because the flag is expressed by one bit, information of a data amount of (one bit x number of pixels) is stored in the frame memory 84. With this configuration, it is possible to significantly reduce the amount of memory as compared with the case where gradations (e.g., 8 bits of information) of all pixels are stored. It should be noted that the calculated flag information may be compressed and the compressed information may be stored. Accordingly, it is possible to further reduce the amount of memory.

The adjustment unit 73 refers to the LUT that stores the corrected value corresponding to the degree of the abnormal response with respect to the pixel whose flag is on, and the corrected value is output (Step 204 subsequent to Step 203). With respect to the pixel whose flag is off, the gradation in the second image signal in the input n-frame is output as it is (Step 204 subsequent to Step 205). As described above, the adjustment may be performed based on the flag stored in the frame memory 84 for each pixel. Also in this adjustment example, it is possible to sufficiently reduce the abnormal response.

(Signal Processing Method 3)

The present inventors have found that the degree of the abnormal response or existence or non-existence of the abnormal response varies depending on not only the light emission state of the pixel to be determined but also the light emission state of pixels around the pixel to be determined. For example, an organic EL element having a tandem structure formed by coupling (laminating) a plurality of units (luminescent units) of an organic layer including luminescent layers of RGB in series (tandem) via a connection layer has been known. An organic EL display device using a method of taking out light of RGB colors with the combination of a white organic EL element having such a tandem structure and a color filter has been known.

An organic EL display device including pixels (sub-pixels) arranged therein has a common layer that is commonly formed for the pixels in many cases. Each of the pixels includes a white organic EL element having such a tandem structure in most cases. Via the common layer, a leakage current flows to surrounding pixels in some cases. The surrounding pixels emit light by the leakage current in some cases. As described above, the light emission state of a pixel is affected by the light emission state of the surrounding pixels.

Therefore, in the case where the pixel to be determined is the low gradation and the surrounding pixels emit light with a high gradation, for example, the pixel to be determined is affected thereby, and no abnormal response can be generated. Therefore, by using the signal processing method described below, it is possible to perform adjustment with a high accuracy, and to display an image with a high quality. The signal processing method uses the gradation of each first frame of the surrounding pixels.

Specifically, the determination unit 72 determines whether or not the gradation of a determination target pixel, which is a pixel to be determined, in the first frame F1 is the low gradation, and the calculated gradation calculated based on the gradation of the at least one surrounding pixel arranged around the determination target pixel in the first frame F1 is in the range from a 0 gradation to a predetermined gradation. Then, the adjustment unit 73 performs the adjustment on the determination target pixel for which the determination results are positive. This will be described in the following.

Figure 12:
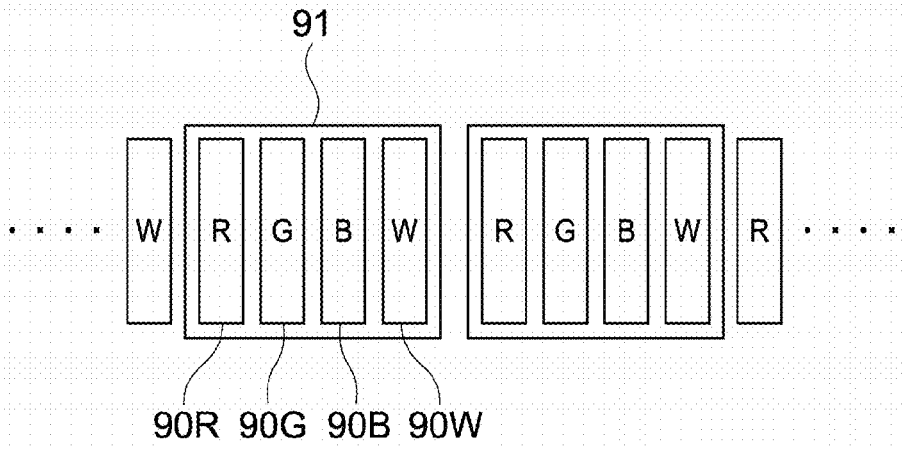
FIG. 12 is a schematic diagram showing a pixel configuration example for explaining another example.
Figure 13:
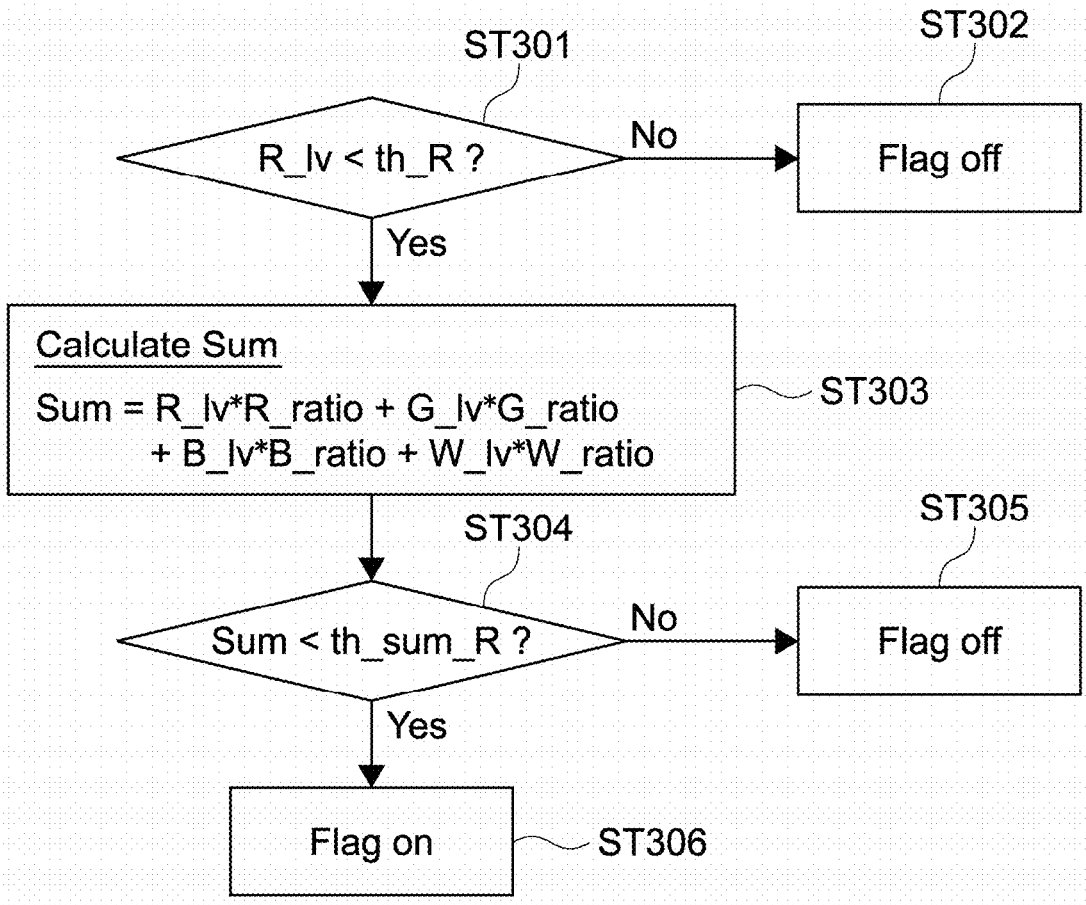
FIG. 13 is a flowchart showing the adjustment example used in the pixel configuration shown in FIG. 12.

FIG. 12 is a schematic diagram showing a pixel configuration example for explaining a signal processing method 3. FIG. 13 is a flowchart showing an example of the adjustment performed in the signal processing method 3. In the example shown in FIG. 12, four sub-pixels 90R, 90G, 90B, and 90W of RGBW constitute one unit pixel 91. It should be noted that the red sub-pixel 90R included in the unit pixel 91 is assumed to be the determination target pixel (hereinafter, referred to as determination target pixel 90R using the same symbol in some cases).

In this adjustment example, as the above-mentioned at least one surrounding pixel, at least one sub-pixel 90G, 90B, and 90W constituting the same unit pixel 91 together with the determination target pixel 90R is used. Therefore, in the case where the gradation of the determination target pixel 90R is the low gradation, and the calculated gradation calculated based on the gradation of the at least one sub-pixels 90G, 90B, and 90W in the first frame F1 is smaller than a predetermined gradation, the gradation adjustment is performed on the determination target pixel 90R.

Regarding flow of the adjustment, as shown in FIG. 13, for example, whether or not a first gradation (R_lv) of the determination target pixel 90R is smaller than a predetermined threshold value (th_R) is determined first. Specifically, whether or not the gradation of the determination target pixel 90R is the low gradation is determined (Step 301). It should be noted that this threshold value may be appropriately set depending on the colors of RGBW.

In the case where the determination in Step 301 is No, the flag is turned off (Step 302). In the case where the determination in Step 301 is Yes, a sum gradation (Sum) is calculated as the calculated gradation (Step 303). The sum gradation is calculated by, for example the following formula (1):

$$\text{Sum}=R_lv\cdot R_\text{ratio}+G_lv\cdot G_\text{ratio}+B_lv\cdot B_\text{ratio}+W_lv\cdot W_\text{ratio} \quad (1)$$

(wherein G_lv represents the gradation of the first frame of the green sub-pixel 90G, B_lv represents the gradation of the first frame of the blue sub-pixel 90B, W_lv represents the gradation of the first frame of the white sub-pixel 90W, R_ratio represents a weighting coefficient, G_ratio represents a weighting coefficient, B_ratio represents a weighting coefficient, and W_ratio represents a weighting coefficient).

As described above, a value obtained by applying weights to the gradations of the determination target pixel 90R and the at least one surrounding pixel (other sub-pixels 90G, 90B, and 90W) in the first frame F1 and summing the weighted values is calculated as the sum gradation. The weighting coefficient may be appropriately set. Typically, the weighting coefficient depending on the kind of the RGBW colors is appropriately set.

Whether or not the calculated sum gradation is smaller than a predetermined threshold value (th_sum_R) is determined (Step 304). The predetermined threshold value may be appropriately set. For example, the predetermined threshold value is set depending on the color of the determination target pixel 90R. The predetermined threshold value may be set in advance and stored.

In the case where the determination in Step 301 is No, the flag is turned off (step 305). In the case where the determination in Step 301 is Yes, the flag is turned on (step 306). For example, with such a signal processing method, it is possible to perform adjustment with a high accuracy, and to display an image with a high quality.

It should be noted that the sub-pixel constituting the unit pixel 91 is not limited to the four sub-pixels of RGBW.

(Signal Processing Method 4)

Figure 14:
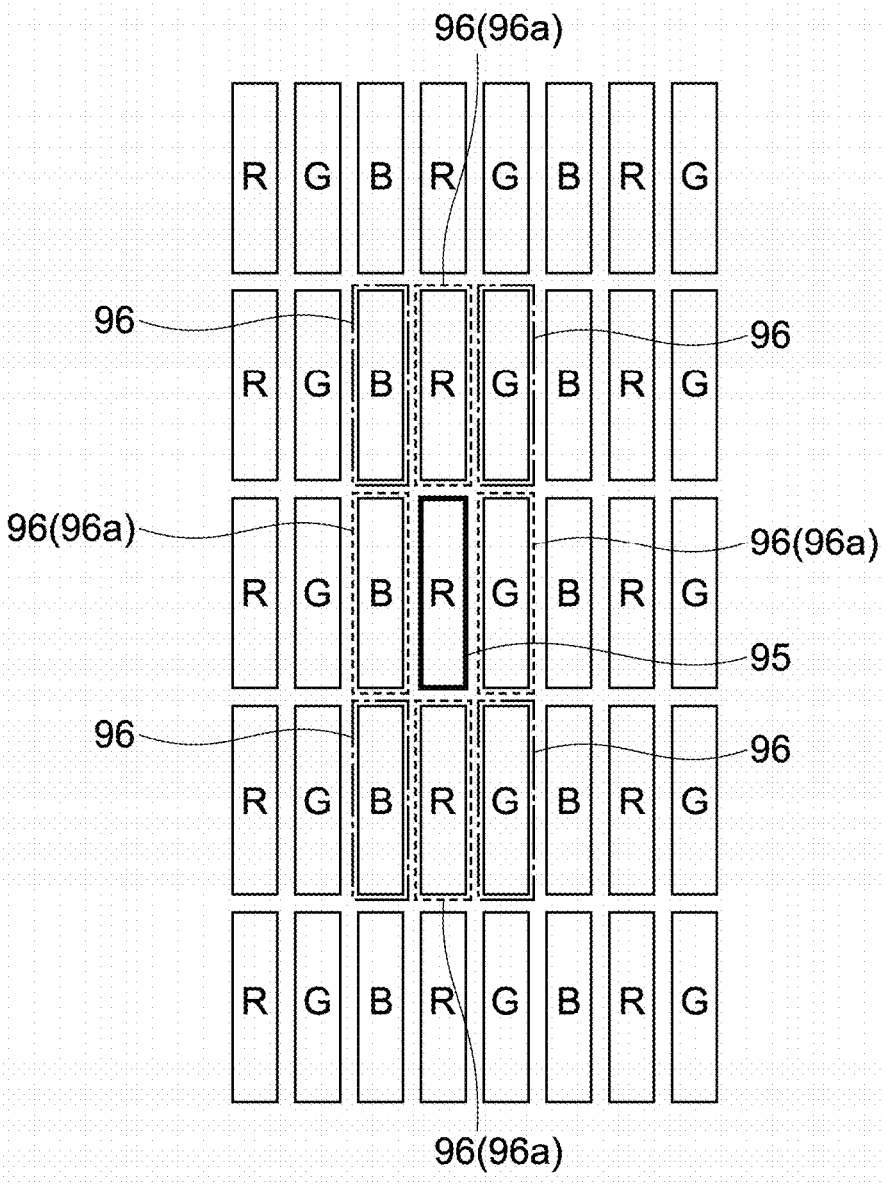
FIG. 14 is a schematic diagram showing a circuit configuration example for explaining the signal processing method according to the embodiment.

FIG. 14 is a schematic diagram showing a circuit configuration example for explaining a signal processing method 4. In this adjustment example, as the above-mentioned at least one surrounding pixel, at least one adjacent pixel 96 adjacent to a determination target pixel 95 is used. In the example shown in FIG. 14, 8 adjacent pixels 96 surrounding the determination target pixel 95 are used as the at least one surrounding pixel. The gradation of the at least one adjacent pixel 96 in the first frame F1 is used to calculate the sum gradation represented by the formula (1), for example. At this time, as a weighting coefficient, a value depending on the distance from the determination target pixel 95 may be set. For example, a larger weighting value is set for an adjacent pixel 96*a* having a smaller distance from the determination target pixel 95.

Which pixel is used as the surrounding pixels can be appropriately set. Both of another sub-pixel constituting the same unit pixel and an adjacent sub-pixel may be used. Alternatively, the at least one surrounding pixel may include pixels adjacent to the adjacent pixels. Moreover, as the method of calculating the calculated gradation, another method may be used.

(Signal Processing Method 5)

Figure 15:
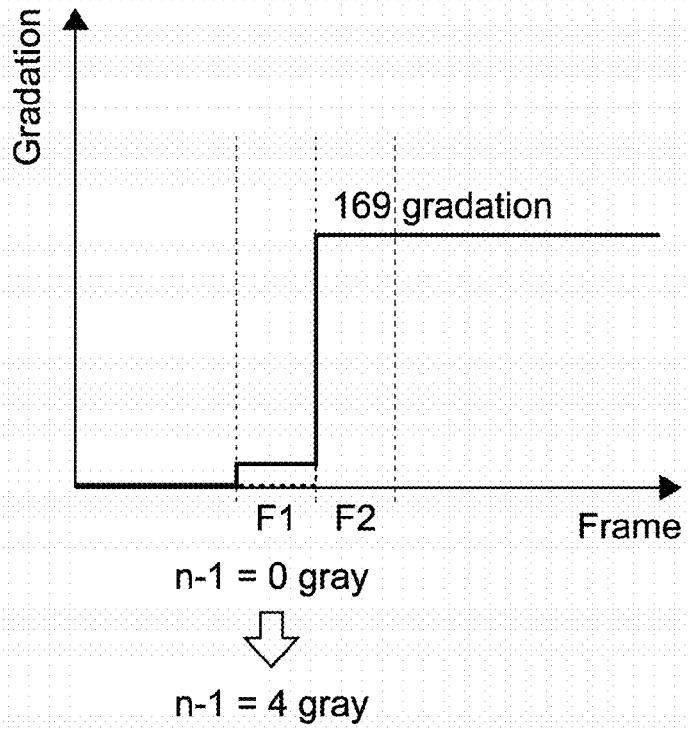
FIG. 15 is a graph showing another example of the adjustment performed in the signal processing method according to the embodiment.

FIG. 15 is a graph showing another example of the adjustment performed in a signal processing method 5. In this adjustment example, it is determined that the gradation is the low gradation in the case where the gradation of the first frame F1 is a 0 gradation. In the pixel that satisfies the determination conditions, the first signal voltage is adjusted so that the first signal voltage is close to the signal voltage corresponding to the high gradation than the signal voltage corresponding to the 0 gradation. Specifically, the gradation in the first image signal in the first frame F1 is adjusted to be more than the 0 gradation. As a result, the first signal voltage is caused to be close to the signal voltage corresponding to the high gradation. The abnormal response may be reduced in this way.

This adjustment example is also a process to slightly adjust the gradation of the first frame in order to prevent the abnormal response from being generated or to reduce the abnormal response. A value after the adjustment may be appropriately set. However, if the adjusted value is too large, the image quality can be reduced. Therefore, a low value such as a 4 gradation is appropriately set as an adjusted value, taking into account the degree of the abnormal response and the image quality.

(Signal Processing Method 6)

Figure 16:
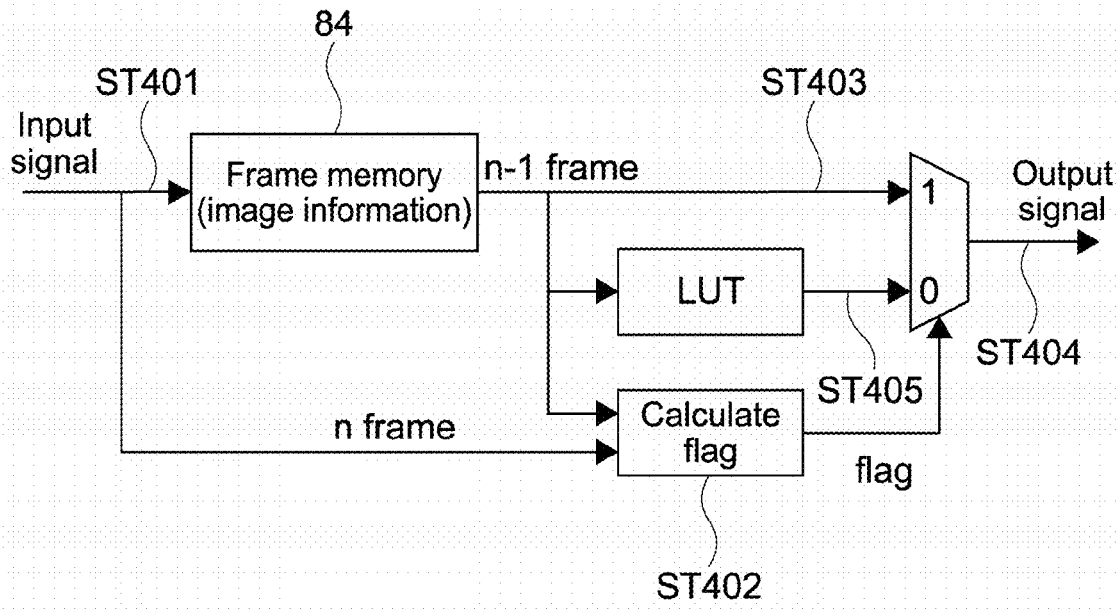
FIG. 16 is a flowchart showing another example of the adjustment performed in the signal processing method according to the embodiment.

FIG. 16 is a flowchart showing another example of the adjustment performed in a signal processing method 6. The first image signal (which may be compressed data) in the n−1 frame is stored in the frame memory 84 (Step 401). The image signal in the n frame is input, and the determination unit 72 performs determination. Specifically, whether or not the gradation of the second frame F2 is larger than the predetermined gradation is determined for each pixel. Then, a flag depending on the determination results is calculated for each pixel (Step 402). To the pixel for which the gradation of the second frame F2 is determined not to be larger than the predetermined gradation, "1(on)" is set as a flag. Moreover, to the pixel for which the gradation of the second frame F2 is determined to be larger than the predetermined gradation, "0(off)" is set as a flag.

The adjustment unit 73 outputs the gradation in the first image signal read from the frame memory 84 as it is for the pixel for which the flag is on (Step 404 subsequent to Step 403). The adjustment unit 73 refers to the LUT that stores the adjusted value, and outputs the adjusted value for the pixel for which the flag is off (Step 404 subsequent to Step 405). Because the adjusted value can be set as a fixed value as described above, it is possible to reduce the data amount of the LUT to be stored.

As described above, the magnitude of the gradation of the second frame F2 may be used as a reference for the determination. This is based on the determination in which the influence of the abnormal response is larger in the case where the gradation of the second frame F2 is high. The threshold value related to the gradation of the second frame F2 only needs to be appropriately set, taking into account the influence of the adjustment of the gradation of the first frame F1 and the influence of the abnormal response.

Figure 17:
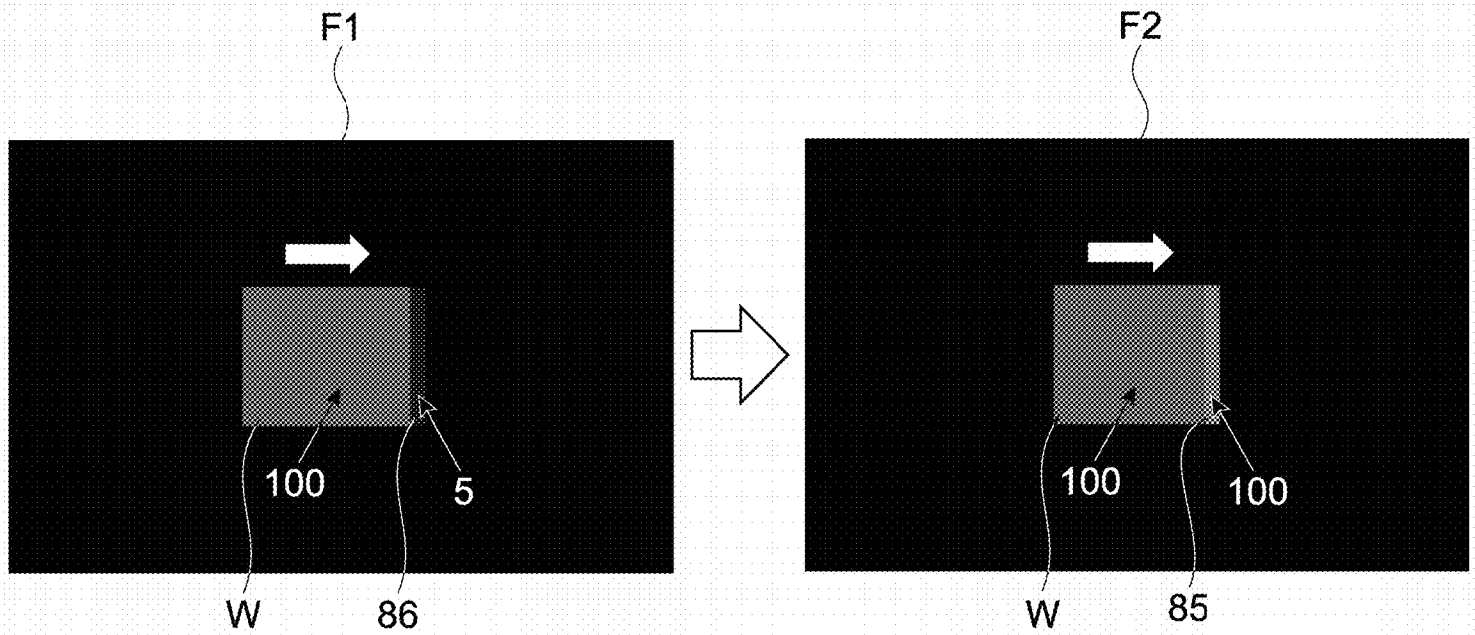
FIG. 17 is a diagram schematically showing the gradation transition in the case where the signal processing method shown in FIG. 16 is used.

FIG. 17 is a diagram schematically showing the gradation transition in the case where this signal processing method is used. As shown in FIG. 17, the area 86 of one pixel adjacent to the window W in the first frame F1 is an area in which the gradation changes from a 0 gradation to a 100 gradation. Therefore, the gradation of the pixel in the first frame F1 in the area 86 is adjusted, and the area 86 is caused to emit light in the amount corresponding to 5 gradations. Accordingly, when the window W is scrolled, it is possible to reduce the abnormal response in the area 85 on the front portion of the window W in the second frame F2. It goes without saying that by appropriately setting the adjusted value, it is possible to cause the area 85 to emit light with a 100 gradation.

It should be noted that in the example shown in FIG. 16, the flag information is set depending on the determination results of the gradation of the second frame F2. Instead of this, the second image signal may be stored in the frame memory 84 as it is, and the determination unit 72 may perform determination based on the second image signal.

Hereinabove, with the signal processing method according to an embodiment of the present disclosure, it is possible to reduce the problem caused due to the transition of the gradation from the low gradation in each pixel of a frame. As a result, it is possible to display an image with a high quality, and to achieve favorable movie properties.

(Electronic Apparatus)

The above-mentioned display device may be incorporated into various electronic apparatuses as a module, for example. For example, the embodiment of the present disclosure can be applied to the smartphone shown in FIG. 18. A smartphone 200 includes a display unit 210 and a non-display unit 220, for example. The display unit 210 includes the display device according to the above-mentioned embodiment.

Moreover, the embodiment of the present disclosure can be applied to a television receiver shown in FIG. 19. A television receiver 300 includes a video display screen unit 300 including a front panel 310 and a filter glass 320, for example. The video display screen unit 300 includes the display device according to the above-mentioned embodiment.

Examples of the electronic apparatus to which the embodiment of the present disclosure can be applied include a digital camera, a laptop personal computer, a portable terminal apparatus such as a mobile phone, and a video camera. In other words, the above-mentioned display device can be applied to an electronic apparatus in any field, which displays, as an image or movie, a video signal input from the outside or a video signal generated therein.

(Other Embodiments)

The present disclosure is not limited to the above-mentioned embodiment, and other various embodiments can be achieved.

In the above description, the adjustment of the first or second signal voltage is performed by adjusting the first or second gradation signal. However, the first signal voltage corresponding to the first gradation signal may be adjusted, or the second signal voltage corresponding to the second gradation signal may be appropriately adjusted. For example, in the case where the gradation of the first frame is determined to be the low gradation, a signal voltage may be generated depending on a gradation signal and the generated signal voltage may be appropriately adjusted. Alternatively, in the case where the gradation of the first frame is determined to be the low gradation, the value of a signal voltage corresponding to a gradation signal may be comprehensively adjusted. Specifically, in the case where a table or the like that represents the correspondence relationship between the gradation signal and the signal voltage is stored, the table may be appropriately selected depending on whether or not the gradation of the first frame is the low gradation.

In the above description, the video signal processing unit generates a signal voltage depending on an image signal, and the signal voltage is supplied to a signal output circuit. However, an adjusted image signal may be supplied from the video signal processing unit to the signal output circuit. Then, the signal output circuit may generate a signal voltage depending on the image signal. Specifically, the signal processing circuit can function as a block for performing the signal processing method according to an embodiment of the present disclosure.

AS the signal processing method according to an embodiment of the present disclosure, the following method may be performed. Specifically, the first gradation signal that represents the gradation of the predetermined pixel in the first frame, and the second gradation signal that represents the gradation of the predetermined pixel in the second frame that follows the first frame are input.

Whether or not the input first gradation signal is a signal corresponding to black display and the input second gradation signal is a signal corresponding to white display is determined. The black display and the white display are typically the lowest gradation and the highest gradation, respectively. However, the display may be defined in a certain range.

In the case where the determination results are positive, the first signal voltage that defines the light-emitting brightness of the light-emitting pixel corresponding to the predetermined pixel in the first frame is adjusted to be close to the signal voltage corresponding to the white display. Alternatively, the second signal voltage that defines the light-emitting brightness of the light-emitting pixel in the second frame is adjusted to be close to the signal voltage corresponding to the black display The signal voltage corresponding to the white display is typically a signal voltage for causing the light-emitting pixel to emit light with 100%, and the signal voltage corresponding to the black display is a signal voltage right before the light-emitting pixel emits light. However, these signal voltages are not limited thereto. Moreover, the extent to which the signal voltages are caused to be close to the respective signal voltage may be appropriately set depending on conditions such as a device. With this signal processing method, it is possible to reduce the problem caused due to the transition from the white display to the black display in each pixel of a frame. As a result, it is possible to display an image with a high quality.

In the above description, the LUT is used to adjust the gradation of the first frame or the second frame. However, it is not limited thereto, and a method of amplifying a signal by multiplying a predetermined coefficient, or offsetting the value by adding or subtracting a predetermined value may be used.

In the above, the corrected value depending on the light emission duty has been described. However, the corrected value or adjusted value may be variably set depending on another factor such as temperature.

In the display device using an organic EL element, an embodiment of the present disclosure can be applied to a drive method different from the above-mentioned drive method, e.g., drive method in which the threshold is not corrected and a DS voltage is set to be constant. In addition, an embodiment of the present disclosure can be applied also to a display device including another type of light-emitting element such as an inorganic EL element, a display device using a light modulation element such as a liquid crystal panel, or the like.

It should be noted that the effects described in the present disclosure are by way of example only and not limited, and other effects may be produced thereby. The above description of the plurality of effects do not necessarily represent that the effects are exerted at the same time. The above description of the effects represents that at least one of the above-mentioned effects can be obtained depending on conditions or the like. It goes without saying that effects that are not described in the present disclosure are exerted in some cases.

At least two feature portions of the embodiments described above can be combined. Specifically, the feature portions described in the explanation for each signal processing method may be arbitrarily combined.

It should be noted that the present disclosure may also take the following configurations.

(1) A signal processing method, including:

inputting a first gradation signal and a second gradation signal, the first gradation signal representing a gradation of a predetermined pixel in a first frame, the second gradation signal representing a gradation of the predetermined pixel in a second frame that follows the first frame;

determining whether or not the gradation of the predetermined pixel in the first frame is a low gradation based on the input first gradation signal; and adjusting one of a first signal voltage and a second signal voltage in a case where the determination result is positive, the first signal voltage defining a light-emitting brightness of a light-emitting pixel corresponding to the predetermined pixel in the first frame, the second signal voltage defining a light-emitting brightness of the light-emitting pixel in the second frame.

(2) The signal processing method according to (1) above, in which the adjusting includes one of adjusting the input first gradation signal to generate a signal voltage corresponding to the adjusted first gradation signal as the first signal voltage and adjusting the input second gradation signal to generate a signal voltage corresponding to the adjusted second gradation signal as the second signal voltage.

(3) The signal processing method according to (1) above, in which the adjusting includes one of adjusting a signal voltage corresponding to the input first gradation signal to generate the first signal voltage and adjusting a signal voltage corresponding to the input second gradation signal to generate the second signal voltage.

(4) The signal processing method according to any one of (1) to (3) above, further including storing a flag corresponding to the result obtained by the determining, the adjusting including performing adjustment based on the stored flag.

(5) The signal processing method according to any one of (1) to (4) above, in which the low gradation represents a gradation in a range from a 0 gradation to a predetermined gradation, and the adjusting includes adjusting the second signal voltage.

(6) The signal processing method according to (5) above, in which the adjusting includes adjusting the second signal voltage based on a light-emitting duty of a light-emitting element arranged as the light-emitting pixel.

(7) The signal processing method according to any one of (1) to (4) above, in which the low gradation is a 0 gradation, and the adjusting includes adjusting the first signal voltage to be a signal voltage closer to a signal voltage corresponding to a high gradation than a signal voltage corresponding to the 0 gradation.

(8) The signal processing method according to (7) above, in which the determining includes determining whether or not the gradation of the predetermined pixel in the second frame is larger than a predetermined gradation based on the second gradation signal, and the adjusting includes performing adjustment in a case where the result obtained by the determining is positive.

(9) The signal processing method according to any one of (1) to (8) above, in which the determining includes determining whether or not the gradation of the predetermined pixel in the first frame is the low gradation and a calculated gradation is in a range from a 0 gradation to a predetermined range, the calculated gradation being calculated based on gradations of at least one surrounding pixel in the first frame, the at least one surrounding pixel being arranged around the predetermined pixel, and the adjusting includes performing adjustment in a case where the result obtained by the determining is positive.

(10) The signal processing method according to (9) above, in which the determining includes performing determination using, as the calculated gradation, values obtained by applying weights to the gradations of the predetermined pixel and the at least one surrounding pixel in the first frame and summing the weighted values.

(11) The signal processing method according to (9) or (10) above, in which the predetermined pixel is a sub-pixel constituting a unit pixel, and the at least one surrounding pixel is at least one sub-pixel constituting the same unit pixel together with the predetermined pixel.

(12) The signal processing method according to (9) or (10) above, in which the at least one surrounding pixel is at least one adjacent pixel adjacent to the predetermined pixel.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing method, comprising:

inputting a first gradation signal and a second gradation signal, the first gradation signal representing a gradation of a predetermined pixel in a first frame, the second gradation signal representing a gradation of the predetermined pixel in a second frame that follows the first frame;

determining whether or not the gradation of the predetermined pixel in the first frame is a low gradation based on the input first gradation signal; and adjusting one of a first signal voltage and a second signal voltage in a case where the determination result is positive, the first signal voltage defining a light-emitting brightness of a light-emitting pixel corresponding to the predetermined pixel in the first frame, the second signal voltage defining a light-emitting brightness of the light-emitting pixel in the second frame, wherein the low gradation represents a gradation in a range from a 0 gradation to a predetermined gradation, and the adjusting includes adjusting the second signal voltage.

2. The signal processing method according to claim 1, wherein the adjusting includes one of adjusting the input first gradation signal to generate a signal voltage corresponding to the adjusted first gradation signal as the first signal voltage and adjusting the input second gradation signal to generate a signal voltage corresponding to the adjusted second gradation signal as the second signal voltage.

3. The signal processing method according to claim 1, wherein the adjusting includes one of adjusting a signal voltage corresponding to the input first gradation signal to generate the first signal voltage and adjusting a signal voltage corresponding to the input second gradation signal to generate the second signal voltage.

4. The signal processing method according to claim 1, further comprising storing a flag corresponding to the result obtained by the determining, the adjusting including performing adjustment based on the stored flag.

5. The signal processing method according to claim 1, wherein the adjusting includes adjusting the second signal voltage based on a light-emitting duty of a light-emitting element arranged as the light-emitting pixel.

6. The signal processing method according to claim 1, wherein the low gradation is a 0 gradation, and the adjusting includes adjusting the first signal voltage to be a signal voltage closer to a signal voltage corresponding to a high gradation than a signal voltage corresponding to the 0 gradation.

7. The signal processing method according to claim 6, wherein the determining includes determining whether or not the gradation of the predetermined pixel in the second frame is larger than a predetermined gradation based on the second gradation signal, and the adjusting includes performing adjustment in a case where the result obtained by the determining is positive.

8. The signal processing method according to claim 1, wherein the determining includes determining whether or not the gradation of the predetermined pixel in the first frame is the low gradation and a calculated gradation is in a range from a 0 gradation to a predetermined range, the calculated gradation being calculated based on gradations of at least one surrounding pixel in the first frame, the at least one surrounding pixel being arranged around the predetermined pixel, and the adjusting includes performing adjustment in a case where the result obtained by the determining is positive.

9. The signal processing method according to claim 8, wherein the determining includes performing determination using, as the calculated gradation, values obtained by applying weights to the gradations of the predetermined pixel and the at least one surrounding pixel in the first frame and summing the weighted values.

10. The signal processing method according to claim 8, wherein the predetermined pixel is a sub-pixel constituting a unit pixel, and the at least one surrounding pixel is at least one sub-pixel constituting the same unit pixel together with the predetermined pixel.

11. The signal processing method according to claim 8, wherein the at least one surrounding pixel is at least one adjacent pixel adjacent to the predetermined pixel.

12. A display device, comprising:

a display unit including a plurality of light-emitting pixels arranged in a two-dimensional form;

an input unit configured to input a first gradation signal and a second gradation signal, the first gradation signal representing a gradation of a predetermined pixel in a first frame, the second gradation signal representing a gradation of the predetermined pixel in a second frame that follows the first frame;

a determination unit configured to determine whether or not the gradation of the predetermined pixel in the first frame is a low gradation based on the input first gradation signal; and an adjustment unit configured to adjust one of a first signal voltage and a second signal voltage in a case where the determination result is positive, the first signal voltage defining a light-emitting brightness of a light-emitting pixel corresponding to the predetermined pixel in the first frame, the second signal voltage defining a light-emitting brightness of the light-emitting pixel in the second frame, wherein the low gradation represents a gradation in a range from a 0 gradation to a predetermined gradation, and the adjusting includes adjusting the second signal voltage.

13. An electronic apparatus, comprising a display device including a display unit including a plurality of light-emitting pixels arranged in a two-dimensional form, an input unit configured to input a first gradation signal and a second gradation signal, the first gradation signal representing a gradation of a predetermined pixel in a first frame, the second gradation signal representing a gradation of the predetermined pixel in a second frame that follows the first frame, a determination unit configured to determine whether or not the gradation of the predetermined pixel in the first frame is a low gradation based on the input first gradation signal, and an adjustment unit configured to adjust one of a first signal voltage and a second signal voltage in a case where the determination result is positive, the first signal voltage defining a light-emitting brightness of a light-emitting pixel corresponding to the predetermined pixel in the first frame, the second signal voltage defining a light-emitting brightness of the light-emitting pixel in the second frame, wherein the low gradation represents a gradation in a range from a 0 gradation to a predetermined gradation, and the adjusting includes adjusting the second signal voltage.

* * * * *